US007339479B2

(12) United States Patent
Nishimura

(10) Patent No.: US 7,339,479 B2
(45) Date of Patent: Mar. 4, 2008

(54) INFORMATION PROCESSING APPARATUS, CONTROL METHOD OF INFORMATION PROCESSING APPARATUS, CONTROL PROGRAM OF INFORMATION PROCESSING APPARATUS, AND RECORDING MEDIUM ON WHICH CONTROL PROGRAM OF INFORMATION PROCESSING APPARATUS IS RECORDED

(75) Inventor: Takashi Nishimura, Kyoto (JP)

(73) Assignee: Omron Corporation, Kyoto (JP)

( * ) Notice: Subject to any disclaimer, the term of this patent is extended or adjusted under 35 U.S.C. 154(b) by 118 days.

(21) Appl. No.: 11/402,897

(22) Filed: Apr. 13, 2006

(65) Prior Publication Data

US 2006/0244601 A1 Nov. 2, 2006

(30) Foreign Application Priority Data

Apr. 15, 2005 (JP) ..... 2005-118536

(51) Int. Cl.
*G08B 13/14* (2006.01)

(52) U.S. Cl. ..... 340/572.1; 340/5.7; 340/539.13; 340/568.1; 340/573.1; 340/686.1; 340/825.49; 235/375

(58) Field of Classification Search ..... 340/572.1, 340/572.2, 573.1, 539.13, 686.1, 686.6, 5.7, 340/10.1, 568.1, 5.92, 825.49, 825.69; 235/375
See application file for complete search history.

(56) References Cited

U.S. PATENT DOCUMENTS 5,682,142 A * 10/1997 Loosmore et al. ..... 340/572.1
6,750,765 B1 * 6/2004 van Wijk ..... 340/505
6,842,121 B1 * 1/2005 Tuttle ..... 340/693.9
6,977,586 B2 * 12/2005 Martin et al. ..... 340/539.15
6,989,749 B2 * 1/2006 Mohr ..... 340/572.1
7,012,534 B2 * 3/2006 Chaco ..... 340/573.1
7,034,690 B2 * 4/2006 Chaco ..... 340/573.1
7,123,149 B2 * 10/2006 Nowak et al. ..... 340/572.1
7,180,422 B2 * 2/2007 Milenkovic et al. ..... 340/572.4
2002/0186121 A1 12/2002 Yoshikawa et al.
2005/0219052 A1 10/2005 Chaco

FOREIGN PATENT DOCUMENTS

EP 1 533 767 A1 5/2005
EP 1 624 416 A2 2/2006
JP 2001-52054 2/2001
JP 2001-74855 3/2001
WO WO 00/70570 11/2000
WO WO 01/99075 A2 12/2001

* cited by examiner

*Primary Examiner*—Davetta W. Goins
(74) *Attorney, Agent, or Firm*—Dickstein Shairo LLP

(57) ABSTRACT

A monitor device is equipped with an external communication section and an information extraction section, which receive position information from a reader/writer that calculates position information of a RFID tag that was disposed on each of plural articles or users, and a specifying section which specifies a combination of a user and an article which enter/leave in/from a safekeeping room concurrently, on the basis of the received position information, and therefore, it is possible to specify a combination of a user and an article which enter/leave in/from the safekeeping room with high precision.

14 Claims, 21 Drawing Sheets

FIG. 7 (a)

| | 50 (msec) | 100 (msec) | 150 (msec) | 200 (msec) | ··· |
|---|---|---|---|---|---|
| USER ID; A | 1 | 3 | 5 | 7 | ··· |
| USER ID; B | - | - | 1 | 2 | ··· |
| USER ID; C | 10 | 8 | 7 | 5 | ··· |
| ⋮ | ⋮ | ⋮ | ⋮ | ⋮ | ··· |

FIG. 7 (b)

| | 50 (msec) | 100 (msec) | 150 (msec) | 200 (msec) | ··· |
|---|---|---|---|---|---|
| ARTICLE ID; α | - | - | - | - | ··· |
| ARTICLE ID; β | 9.5 | 7.5 | 6.5 | 4.5 | ··· |
| ARTICLE ID; γ | - | - | - | - | ··· |
| ⋮ | ⋮ | ⋮ | ⋮ | ⋮ | ··· |

FIG. 8

| | ARTICLE α (ARTICLE ID; α) | ARTICLE β (ARTICLE ID; β) | ARTICLE γ (ARTICLE ID; γ) | ··· |
|---|---|---|---|---|
| USER A (USER ID; A) | ○ | × | ○ | ··· |
| USER B (USER ID; B) | ○ | × | × | ··· |
| USER C (USER ID; C) | ○ | ○ | × | ··· |
| ⋮ | ⋮ | ⋮ | ⋮ | ··· |

INFORMATION PROCESSING APPARATUS, CONTROL METHOD OF INFORMATION PROCESSING APPARATUS, CONTROL PROGRAM OF INFORMATION PROCESSING APPARATUS, AND RECORDING MEDIUM ON WHICH CONTROL PROGRAM OF INFORMATION PROCESSING APPARATUS IS RECORDED

The present application claims foreign priority based on Japanese Patent Application No. 2005-118536, filed Apr. 15, 2005, the content of which is incorporated herein by reference.

BACKGROUND OF THE INVENTION

1. Technical Field

This invention relates to an information processing apparatus which specifies monitor targets that enter in and leave from a predetermined region, concurrently, a control method of an information processing apparatus, a control program of an information processing apparatus, and a recording medium on which a control program of an information processing apparatus is recorded.

2. Related Art

In recent years, utilization of RFID (Radio Frequency Identification) tags (wireless tags) is about to become widely used, and for example, utilization in a wide range of fields such as process management, article management, quality management, or sales management is expected. For example, as an utilization example of the such like RFID tag, there is technology for monitoring a trend of articles or humans which exist in a predetermined region.

For example, Patent Document 1 (JP-A-2001-74855 publication (published on Mar. 23, 2001)) discloses an action information specifying device which carries out identification of a human body and a material body by utilizing this RFID tag, on the occasion of detecting entering/leaving of a human body and a material body in/from a room.

In addition, Patent Document 2 (JP-A-2001-52054 publication (published on Feb. 23, 2001) discloses an article taking-out management system which judges whether a user took out an article or not, on the basis of a RFID tag attached to each article which is displayed on a display rack, and a response wave obtained from a RFID tag which is brought with a user.

However, in a configuration shown in the above-mentioned Patent Document 1, there occurs such a problem that it is not possible to manage leaving-room of a human with high precision. That is, in the configuration of Patent Document 1, it is of such a configuration that leaving-room of a human is detected by an infrared ray sensor, but it is not possible to accurately detect leaving-room of a human, in case that a plurality of humans leave a room simultaneously, and an entering-room person and a leaving-room person pass transversely across a front of the infrared ray sensor simultaneously.

In addition, in a configuration shown in the above-mentioned Patent Document 2, there occurs such a problem that it is not possible to accurately get hold of a user who took out an article. That is, in the configuration of Patent Document 2, it can be recognized that a user went out with an article, from a range where it is possible to communicate with a RFID tag (communication area), but it can not be recognized which user took out an article, in case that a plurality of users exit from the range where it is possible to communication, simultaneously. That is, it is not possible to specify a user who has an article among users who went out from the range where it is possible to communicate.

On this account, in order to prevent a plurality of users from entering in and leaving from a communication area simultaneously, there is need to restrict a range where a user can enter and leave, for example, by a gate etc.

SUMMARY OF THE INVENTION

An object is to provide an information processing apparatus which can specify a combination of monitor targets which enter in and leave from a predetermined region, with high precision, without restricting a range where a monitor target can enter in and leave from the predetermined region, a control method of the information processing apparatus, a control program of the information processing apparatus, and a recording medium on which the control program of the information processing apparatus is recorded.

However, the present invention need not achieve the above objects, and other objects not described herein may also be achieved. Further, the invention may achieve no disclosed objects without affecting the scope of the invention.

An information processing apparatus, which relates to the present invention, is an information processing apparatus which carries out processing for receiving information from a communication device that calculates position information of an identification device in a communication area by communication with the identification device which is disposed for each of plural monitor targets, in order to solve the above-mentioned problem, and characterized by having a reception section which receives the calculated position information from the communication device, and a specifying section which specifies a combination of monitor targets which enter in and leave from a predetermined region concurrently, on the basis of position information received by the reception section. Meanwhile, the above-mentioned monitor target includes various things such as a human, an article, and an animal.

According to the above-mentioned configuration, since the information processing apparatus, which relates to the present invention, has the reception section that receives position information, it can get hold of a position of each monitor target for which each identification device is disposed. In addition, since it has the specifying section, it can specify a combination of monitor targets which enter in and leave from the predetermined region concurrently, on the basis of position information of each monitor target.

That is, in the information processing apparatus which relates to the present invention, the above-mentioned specifying section can specify a combination of monitor targets which enter in and leave from the predetermined region, by confirming position information of each monitor target in a communication area. For example, in case that there is a combination of monitor targets which move over keeping mutually adjacent positions and enter in and leave from the predetermined region, it is possible to judge that these monitor targets enter in and leave from the predetermined region concurrently.

In addition, even in case that a plurality of monitor targets enter in and leave from the predetermined region nearly simultaneously, the above-mentioned specifying section judges entering/leaving in/from the predetermined region on the basis of position information, and therefore, it can specify a combination of monitor targets which enter and leave concurrently. That is, in the information processing apparatus which relates to the present invention, there is no need to restrict the number of monitor targets which can enter in and leave from the predetermined region nearly simultaneously, in order to be able to specify a combination of monitor targets which enter in and leave from the predetermined region concurrently.

On this account, in the information processing apparatus which relates to the present invention, there is no need to restrict a range where a monitor target can enter and leave, by for example, a gate etc., in order to specify a combination of monitor targets which enter in and leave from the predetermined region concurrently.

Thus, the information processing apparatus, which relates to the present invention, performs such an advantage that it is possible to specify a combination of monitor targets which enter in and leave from the predetermined region with high precision, without restricting a range which enables entering/leaving of a monitor target in/from the predetermined region, on the basis of position information in a communication area of each monitor target.

In addition, the information processing apparatus relating to the present invention, further has, in the above-mentioned configuration, an entering/leaving judgment section which judges presence or absence of entering-in/leaving-from a predetermined region of at least one monitor target, among the plural monitor targets, on the basis of the position information, and it is desirable that it is configured in such a manner that, in case that the above-mentioned entering/leaving judgment section judges that there is a monitor target which enters in and leaves from the predetermined region, the above-mentioned specifying section specifies another monitor target which enters in and leaves from the predetermined region, together with the monitor target, on the basis of the position information.

According to the above-mentioned configuration, since it has the entering/leaving judgment section, it is possible to specify a monitor target which enters in and leaves from the predetermined region, by confirming a position of a monitor target, on the basis of the above-mentioned position information.

On this account, there is no need for the above-mentioned specifying section to refer to position information relating to all monitor targets, and it is all right if position information of only the specified monitor target is referred, and therefore, it is possible to effectively specify anther monitor target which enters and leave together with the monitor target.

In addition, the information processing apparatus relating to the present invention may be configured in such a manner that, in case that it is judged by the entering/leaving judgment section that plural monitor targets enter in and leave from the predetermined region nearly simultaneously, the specifying section specifies a combination of monitor targets which enter in and leave from the predetermined region concurrently, about each of the monitor targets, on the basis of position information of each of the monitor targets.

According to the above-mentioned configuration, it is possible to specify a combination of monitor targets which enter in and leave from a predetermined region, respectively, on the basis of position information of each of the monitor target, as to each of monitor targets which enter in and leave from the predetermined region nearly simultaneously.

In this manner, even in case that a plurality of monitor targets enter in and leave from the predetermined region nearly simultaneously, it is possible to specify a combination of monitor targets which enter in and leave from the predetermined region concurrently, and therefore, there is no need to restrict a range where it is possible to enter and leave, in the predetermined region, by for example, a gate etc., and to restrict the number of monitor targets which enter and leave.

Therefore, the information processing apparatus, which relates to the present invention, can specify a combination of monitor targets which enter in and leave from the predetermined region, with high precision, without restricting a range where a monitor target can enter in and leave from the predetermined region, on the basis of position information in a communication area of each monitor target.

In addition, the information processing apparatus relating to the present invention, is configured in such a manner that, in the above-mentioned configuration, in case that a monitor target for which it is judged by the entering/leaving judgment section that there is entering/leaving in/from the predetermined region is set as a first monitor target, the specifying section specifies a second monitor target which exists in a predetermined distance range from the first monitor target, to be a monitor target which enters in and leave from the predetermined region together with the first monitor target.

In the meantime, as to the first monitor target and the second monitor target which are allowed to enter in and leave from the predetermined region concurrently, the second monitor target is to exist in a predetermined distance range from the first monitor object. For example, in case that the first monitor target is a human and the second monitor target is an article kept by the human and both sides enter in and leave from the predetermined region concurrently, the second monitor target is to exist in a range of such a distance that it can be always kept by the human as the first monitor target.

Meanwhile, this predetermined distance range is such a range that a user gripping an article can move the article on up and down, left and right, back and forth of oneself, in case that for example, one of monitor targets is a human and the other is an article which can be gripped by a human.

According to the above-mentioned configuration, since it has the above-mentioned specifying section, it is possible to specify the second monitor target, which exists in a predetermined distance range from the first monitor target for which entering/leaving is confirmed by the entering/leaving judgment section, to be a monitor target which enters in and leaves from the predetermined region concurrently with the first monitor target.

As above, in the information processing apparatus which relates to the present invention, it is possible to specify the second monitor target, which is a monitor target that exists in a predetermined distance range, based on the first monitor target which enters in and leaves from the predetermined region, to be a monitor target which enters and leaves concurrently with the first monitor target. In this manner, the information processing apparatus, which relates to the present invention, can easily specify monitor targets which enter in and leave from the predetermined region concurrently.

In addition, the information processing apparatus relating to the present invention may further has a history recording device which records history information that is a history of position information received from a communication device by the reception section, and may be configured in such a manner that the entering/leaving judgment section judges entering/leaving of the monitor target in/from a predetermined region, on the basis of the history information.

According to the above-mentioned configuration, since it further has the history storage device, it is possible to get hold of chronological displacement of monitor targets. In this manner, it is possible to get hold of chronological displacement of monitor targets, and therefore, it is possible to know displacement of positions in such a process that monitor targets enter in and leave from the predetermined region, respectively. Then, it is possible to specify monitor targets which are displaced each other at nearly the same positions, to be things which enter in and leave from the predetermined region concurrently.

On this account, the information processing apparatus, which relates to the present invention, can prevent another monitor target, which fortuitously entered in and left from a similar position in the predetermined region, from being erroneously specified to be a monitor target which enters and leaves concurrently.

Therefore, the information processing apparatus, which relates to the present invention, can specify a combination of monitor targets which enter in and leave from the predetermined region concurrently, with high precision, on the basis of history information which is a history of position information in a communication area of each monitor target, without restricting a range in which a monitor target can enter in and leave from the predetermined region.

In addition, in the information processing apparatus relating to the present invention, it is all right even if the position information is information which shows a distance from the identification device up to the communication device, in the above-mentioned configuration.

Since the position information is distance information, the above-mentioned specifying section can specify a combination of monitor targets which enter in and leave from the predetermined region concurrently, depending on displacement of this distance information.

For example, in case of providing the above-mentioned communication device at a gateway of the predetermined region and of enabling communication only with an identification device in the predetermined region, it is possible to specify a combination of monitor targets which enter and leave concurrently, as described below.

That is, if communication with an identification device breaks up, in a distance range between the identification device and a communication device, which can be taken by a monitor target equipped with the identification device on the occasion that it passes through the above-mentioned gateway, it is recognized that the monitor target equipped with this identification device left from the predetermined region.

In addition, in case that timing where this communication breaks up is nearly the same timing and there exists another monitor target which is present at such a distance that the distance where communication broke up is the same as that of the above-mentioned monitor target, the specifying section can specify the another monitor target as a thing which leaves out concurrently with the above-mentioned monitor target.

In addition, in the information processing apparatus relating to the prevent invention, it is desirable that the position information is a two-dimensional coordinate or a three-dimensional coordinate of the identification device in a predetermined region, in the above-mentioned configuration.

The above-mentioned position information is a two-dimensional coordinate or a three-dimensional coordinate of the identification device, in the predetermined region. That is, it is possible to specify a position of the identification device by a coordinate point of a predetermined region space, and therefore, the specifying section can get hold of entering/leaving of a monitor target in/from the predetermined region, as to which position of the predetermined region it went out from, or which position it entered from, etc., in detail.

Therefore, in the information processing apparatus relating to the present invention, the specifying section can specify monitor targets which entered in and left from the predetermined region from nearly the same position, at nearly the same timing, with high precision. On this account, the information processing apparatus can specify a combination of monitor targets which enter and leave concurrently, with high precision, with reference to the position information, even in case that a plurality of monitor targets entered in and left from the predetermined region around the same time.

In addition, in the information processing apparatus relating to the present invention, it is desirable to be of a configuration which is equipped with a combination information storage device which stores combination information that shows advisability of a combination of monitor targets that enter in and leave from the predetermined region, and an advisability judgment section which judges, in a combination of monitor targets which are specified by the specifying section, that both of them can be entered and left, concurrently, on the basis of the combination information, in the above-mentioned configuration.

According to the above-mentioned configuration, since it is equipped with the advisability judgment section, it is possible to judge whether a combination of monitor targets, which are specified by the specifying section to enter in and leave from the predetermined region concurrently, is appropriate or not.

That is, in case that a combination of monitor targets, which can enter in and leave from the predetermined region concurrently, is restricted in advance, it is possible to judge advisability of this restricted combination by the advisability judgment section.

On this account, it is possible to restrict appropriately, in a manner of enabling entering/leaving of only a combination of monitor targets which are allowed to enter in and leave from the predetermined region.

In addition, the information processing apparatus, which relates to the present invention, may be configured so as to be equipped with an output section which outputs information that shows a judgment result by the advisability judgment section, in the above-mentioned configuration.

According to the above-mentioned configuration, since it is equipped with the output section, it is possible to output a judgment result by the advisability judgment section, and to inform advisability of a combination of monitor targets which enter in and leave from the predetermined region, to for example, a manager which manages the information processing apparatus.

In addition, in the information processing apparatus relating to the present invention, it is desirable that the identification device is a RFID tag, in the above-mentioned configuration. In case that the identification device is a RFID tag, it is possible to store information regarding a monitor target where an identification is disposed, and therefore, it is possible to read out the information regarding the monitor target, and to monitor each monitor target individually.

A monitor system is characterized, in order to solve the above-mentioned problem, by having the above-mentioned information processing apparatus, and a communication device having a position information calculation section which calculates position information of each of identification devices, on the basis of a signal which is transmitted from the identification device which is disposed for each of plural monitor targets, and a transmission section which transmits the calculated position information to the information processing apparatus.

According to the above-mentioned configuration, since the communication device has a position measurement section, it is possible to calculate position information of each identification device. In addition, the information processing apparatus can acquire the position information calculated by the communication device.

On this account, the monitor system, which relates to the present invention, performs such an advantage that it is possible to specify a combination of monitor targets which enter in and leave from the predetermined region concurrently, with high precision, on the basis of position information in a communication area of each monitor target, without restricting a range where a monitor target can enter in and leave from the predetermined region.

A control method of an information processing apparatus, which relates to the present invention, is a control method of an information processing apparatus of carrying out processing for receiving information from a communication device which calculates position information of an identification device, in a communication area, by communication with the identification device which is disposed for each of plural monitor targets, in order to solve the above-mentioned problem, and characterized by including a step of receiving the calculated position information from the communication device, and a step of specifying a combination of monitor targets which enter in and leave from a predetermined region, on the basis of the received position information.

According to the above-mentioned method, since it includes the step of receiving the calculated position information, it is possible to get hold of a position of each monitor target equipped with an identification device. In addition, since it includes the step of specifying a combination of monitor targets which enter in and leave from the predetermined region concurrently, it is possible to specify monitor targets which enter in and leave from the predetermined region concurrently, on the basis of position information of each monitor target.

In this manner, in the control method of the information processing apparatus which relates to the present invention, it is possible to specify a combination of monitor targets which enter in and leave from the predetermined region, by confirming position information of each monitor target in a communication area. For example, in case that there is a combination of monitor targets which move each other over keeping adjacent positions and enter in and leave from the predetermined region, it is possible to judge that these monitor targets enter in and leave from the predetermined region concurrently.

Therefore, the control method of the information processing apparatus, which relates to the present invention, performs such an advantage that it is possible to specify a combination of monitor targets which enter in and leave from the predetermined region concurrently, with high precision, on the basis of position information in a communication area of each monitor target, without restricting a range where a monitor target can enter in and leave from the predetermined region.

Meanwhile, each section, which the information processing has, may be realized by a computer, and in this case, a computer readable recording medium, on which a control program of an information processing apparatus for realizing the information processing apparatus through the use of a computer by having the computer operated as the each section, falls under the category of the present invention.

An information processing apparatus, which relates to the present invention, is an information processing apparatus which carries out processing for receiving information from a communication device that calculates position information of an identification device in a communication area by communication with the identification device which is disposed for each of plural monitor targets, and characterized by having a reception section which receives the calculated position information from the communication device, and a specifying section which specifies a combination of monitor targets which enter in and leave from a predetermined region concurrently, on the basis of position information received by the reception section.

Therefore, the information processing apparatus, which relates to the present invention, performs such an advantage that it is possible to specify a combination of monitor targets which enter in and leave from the predetermined region, with high precision, on the basis of position information in a communication area of each monitor target, without restricting a range where a monitor target can enter in and leave form the predetermined region.

A monitor system, which relates to the present invention, is characterized, as described above, by having the above-mentioned information processing apparatus, and a communication device having a position information calculation section which calculates position information of each of identification devices, on the basis of a signal which is transmitted from the identification device which is disposed for each of plural monitor targets, and a transmission section which transmits the calculated position information to the information processing apparatus.

On this account, the monitor system, which relates to the present invention, performs such an advantage that it is possible to specify a combination of monitor targets which enter in and leave from the predetermined region, with high precision, on the basis of position information in a communication area of each monitor target, without restricting a range where a monitor target can enter in and leave form the predetermined region.

A control method of an information processing apparatus, which relates to the present invention, is, as described above, a control method of an information processing apparatus of carrying out processing for receiving information from a communication device which calculates position information of an identification device, in a communication area, by communication with the identification device which is disposed for each of plural monitor targets, and characterized by including a step of receiving the calculated position information from the communication device, and a step of specifying a combination of monitor targets which enter in and leave from a predetermined region, on the basis of the received position information.

Therefore, the control method of the information processing apparatus, which relates to the present invention, performs such an advantage that it is possible to specify a combination of monitor targets which enter in and leave from the predetermined region, with high precision, on the basis of position information in a communication area of each monitor target, without restricting a range where a monitor target can enter in and leave form the predetermined region.

BRIEF DESCRIPTION OF THE DRAWINGS

FIG. 4(*b*) is a view which shows a signal and its carrier frequency transmitted from the reader/writer to the RFID tag and a signal and its carrier frequency transmitted from the RFID tag to the reader/writer by the time axis.

FIG. 7 is a thing which shows one example of history information to be stored in an information storage section that relates to this embodiment, and the same figure (a) is a view which shows a history of distance information of RFID tag which each user is equipped with, and the same figure (b) is a view which shows a history of distance information which each article is equipped with.

FIG. 8 is a view which shows one example of certification information to be stored in the information storage section that relates to this embodiment.

DETAILED DESCRIPTION OF THE INVENTION

Embodiment 1

Figure 1:
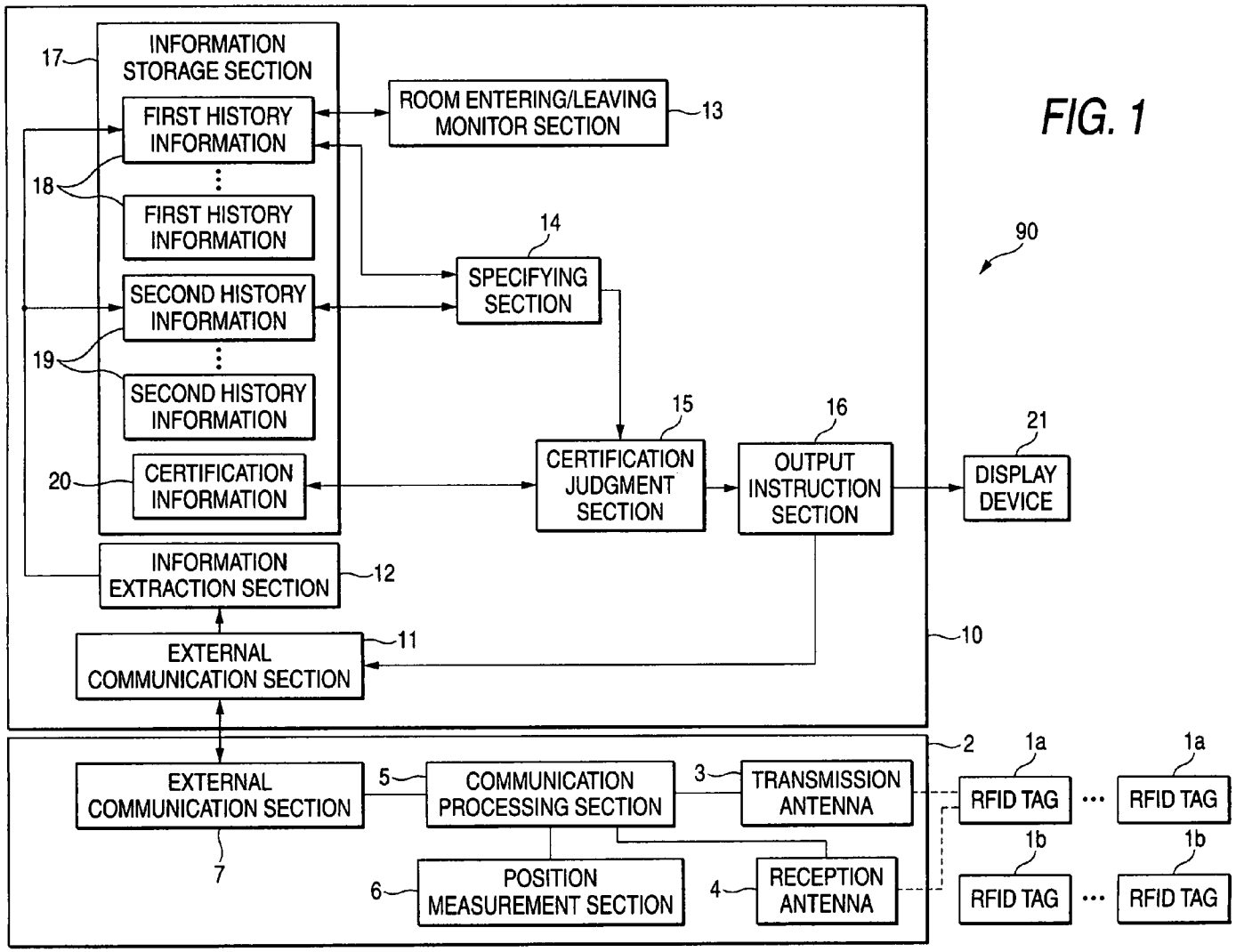
FIG. 1 is a thing which shows an exemplary, non-limiting embodiment of the present invention, and is a block diagram which shows a substantial part configuration of a monitor system.

Explaining one embodiment of the present invention on the basis of FIGS. 1 through 15, it is as described below. That is, a monitor system 90, which relates to this embodiment, is a thing which monitors entering/leaving of an article and a user who posses the article, in a safe keeping room 10, as shown in FIG. 2. More concretely speaking, this monitor system 90 records displacement of an article and a user, and judges advisability of a user's taking out an article from the safekeeping room 100.

In this monitor system 90, each article is equipped with a RFID tag (identification device) 1*a*, and in addition, each user, who walks in the safekeeping room 100, keeps a permit of entering in a room, etc., in which a RFID tag (identification device) 1*b* was incorporated in.

Then, when a user holding an article passes through a gate 80, position information of each of the RFID tag 1*a* equipped with the article and the RFID tag 1*b* provided with a user are calculated by a reader/writer (communication device) 2 which was set up to the gate 80. Then, it is configured in such a manner that, on the basis of this calculated position information, a monitor device (information processing apparatus) 10 judges advisability of taking-out of the article.

In addition, in this embodiment, a type of an article, which can be take out, is limited by a user. Then, in the above-mentioned monitor system 90, it judges whether permission of taking out the article from an inside of the safekeeping room (predetermined region) 100 is obtained or not, by a user who posses the article. Meanwhile, this FIG. 2 is a view which shows one example of the monitor system 90 relating to this embodiment.

Here, with reference to FIG. 1, a configuration of the monitor system 90 relating to this embodiment will be explained in more detail. Meanwhile, this FIG. 1 is a block diagram which shows a substantial part configuration of the monitor system 90 relating to this embodiment.

(Configuration of Monitor System)

Figure 2:
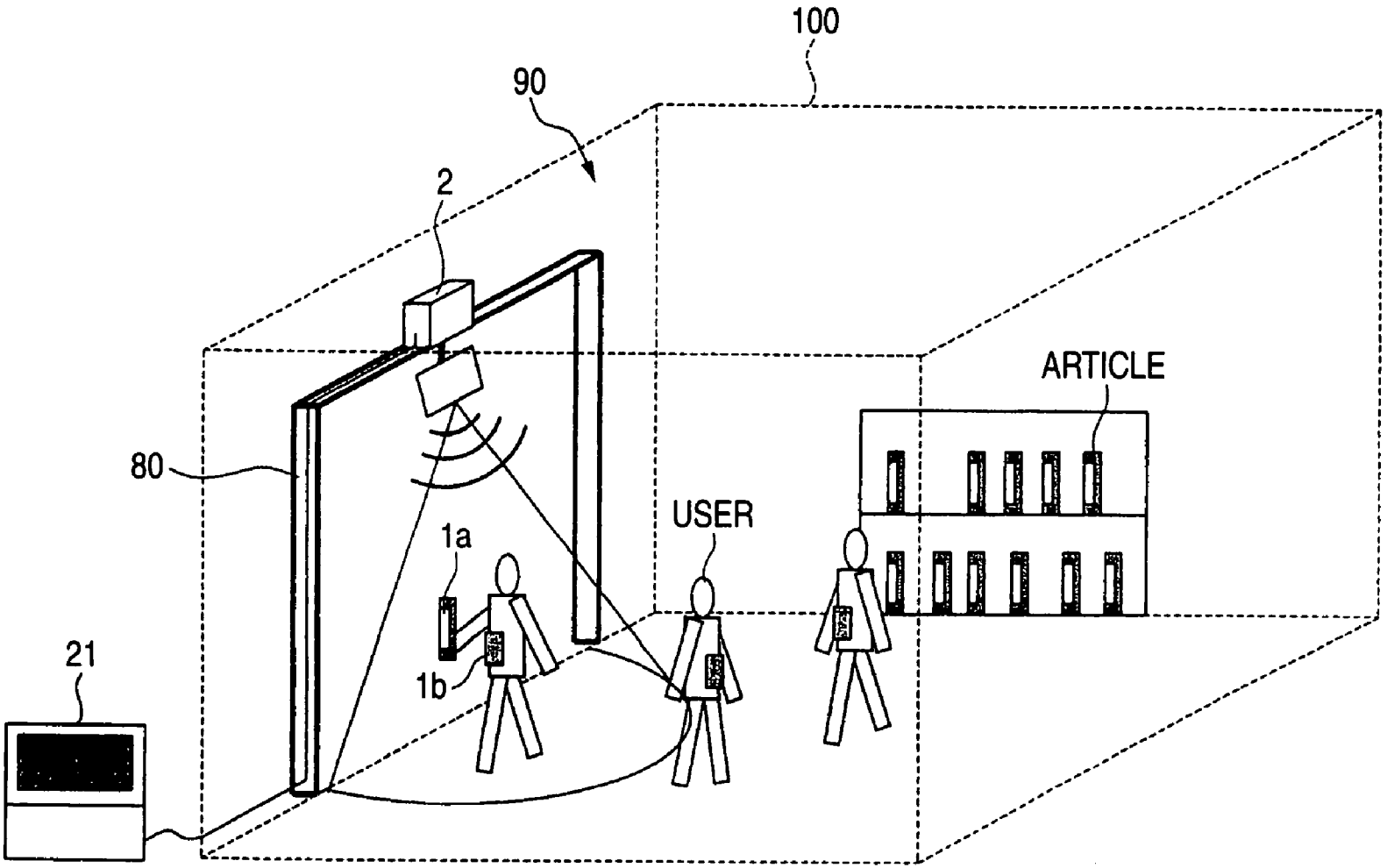
FIG. 2 is a thing which shows an exemplary, non-limiting embodiment of the present invention, and is a view which schematically shows one example of a warehouse entering/leaving management system.

The monitor system 90, which relates to this embodiment, is made as a configuration equipped with one or more RFID tags 1*a* . . . , and one or more RFID tags 1*b* . . . , the reader/writer 2, and the monitor device 10, as shown in FIG. 1.

The RFID tag 1*a* and the RFID tag 1*b* are things which are attached to various articles and humans, and are things which hold information relating to articles and humans to which they are attached. Meanwhile, in this embodiment, for the sake of simplicity of explanations, a RFID tag, which is equipped with an article, is set as the RFID tag 1*a*, and a RFID tag, which a human is equipped with, is set as the RFID tag 1*b*, but in case that there is no need to differentiate them particularly, they are simply referred to as RFID tag 1.

In addition, the RFID tag 1 is configured so as to be equipped with a wireless communication IC (Integrated Circuit), a storage section, and an antenna etc., although they are not shown in the figure. Meanwhile, in this embodiment, as the RFID tag 1, a passive type RFID tag 1 without a power source such as a battery, in which a circuit is operated by electric power transmitted from the reader/writer 2 by electromagnetic waves to carry out wireless communication with the reader/writer 2, is used.

However, the RFID tag 1, which is used in this embodiment, is not limited to the above-described passive type RFID tag, and may be an active type RFID tag having a power source such as a battery.

The reader/writer 2 is a device which carries out wireless communication with each RFID tag 1, and reads and write information stored in the RFID tag 1. Meanwhile, in this embodiment, the reader/writer 2 is explained as a thing which carries out reading/writing of information stored in the RFID tag 1, but it is not limited to this, and may be a RFID reader which carries out only reading of information stored in the RFID tag 1.

In this embodiment, a frequency band of electromagnetic waves, which are transmitted and received by the reader/writer 2, is set as a so-called UHF band of approximately 800 MHz through 960 MHz. By using electromagnetic waves in the such like frequency band, it becomes possible for the reader/writer 2 to communicate with the RFID tag 1 which is located in a distance range of approximately several m through several 10 m. Meanwhile, this embodiment assumes communication using the UHF band, but it is not limited to this, and it is all right even if a frequency band such as 13.56 MHz band and 2.45 GHz band, is used as a frequency band for RFID tags, and furthermore, it is all right even if communication is carried out by use of another frequency band in which it is possible to carry out communication by wireless.

Meanwhile, a detailed configuration of the above-mentioned reader/writer 2 will be described later.

The above-mentioned monitor device 10 is a device which judges taking-out permission of an article to an outside of the user's safekeeping room 100, on the basis of information read from the RFID tag 1 through the reader/writer 2 and position information. Meanwhile, a detailed configuration of this monitor device 10 will be described later.

(Configuration of Reader/Writer)

Firstly, a configuration of the reader/writer 2 will be hereinafter explained with reference to FIG. 1.

The above-mentioned reader/writer 2 is configured so as to be equipped with a transmission antenna 3, a reception antenna 4, a communication processing section 5, a position measurement section (position information calculation section) 6, and an external communication section 7.

The transmission antenna 3 is an antenna for transmitting electromagnetic waves to the RFID tag 1, and the reception antenna 4 is an antenna for receiving electromagnetic waves which comes from the RFID tag 1. These transmission antenna 3 and reception antenna 4 are configured by, for example, a patch antenna, an array antenna and soon. Meanwhile, in this configuration example, the transmission antenna 3 and the reception antenna 4 are disposed separately, but it is all right even if it is configured so as to use one antenna as a thing which has both functions of the transmission antenna 3 and the reception antenna 4.

The communication processing section 5 is a block which carries out various controls relating to communication between the reader/writer 2 and the RFID tag 1 relating to this embodiment. Concretely speaking, the communication processing section 5 carries out processing such as modulation and amplification of transmission signals which are transmitted from the transmission antenna 3, and carries out processing such as amplification and demodulation of reception signals which are received in the reception antenna 4.

In addition, the communication processing section 5 is also a block which carries out reading and/or writing control of information through the transmission antenna 3 and/or the reception antenna 4. Meanwhile, reading and/or writing control of information to this RFID tag 1 is carried out depending on an instruction which is received from the monitor device 10 through the external communication section 7.

The position measurement section 6 is a block which measures a position of the RFID tag 1, on the basis of the reception signal received from the RFID tag 1. Although details will be described later, measurement of a distance between the reader/writer 2 and the RFID tag 1, measurement of a direction of the RFID tag 1 on the occasion of being viewed from the reader/writer 2, and measurement of a spatial position of the RFID tag 1, etc., are cited as measurement of a position of the RFID tag 1.

Meanwhile, the distance between the reader/writer 2 and the RFID tag 1 is, in a precise sense, comparable to a weighted average of a distance between the transmission antenna 3 in the reader/writer 2 and the RFID tag 1, and a distance between the RFID tag 1 and the reception antenna 4. Meanwhile, in case that the RFID tag 1 is of an active type, it is comparable to a distance between the reception antenna 4 and the RFID tag 1.

The external communication section 7 is a block which transmits information of the RFID tag, which was read out by the reader/writer 2, to the monitor device 10, and receives information to be written from the monitor device 10 to the RFID tag 1. Communication connection is carried out by wire between the monitor device 10 and the external communication section 7, but it may be configured so as to be connected by wireless. In addition, it is all right even if the monitor device 10, which is operated on the basis of reading processing to the RFID tag 1 by the reader/writer 2, is configured so as to have the reader/writer 2 built-in.

(Configuration Regarding Distance Measurement)

Next, one example of a configuration for measuring a distance between the RFID tag 1 and the reader/writer 2, in the reader/writer 2, will be explained over referring to FIG. 3. As shown in the same figure, the communication processing section 5 is equipped with a PLL (Phase Locked Loop) section 5A as a frequency adjustment section, a modulation section 5B, a power amplification section 5C, an amplification section 5D, a frequency conversion section 5E, a frequency control section 5F, a transmission control section 5G, a reception control section 5H, and an oscillator 5I. In addition, the position measurement section 6 is equipped with a phase information acquiring section 6A and a distance calculation section 6B.

In the communication processing section 5, the PLL section 5A is a block which sets up carrier frequency of transmission signals which are transmitted from the transmission antenna 3, and configured by a PLL circuit. The modulation section 5B carries out processing of overlapping data with the transmission signals by applying modulation to carrier signals generated by the PLL section 5A and the oscillator 5I.

In this embodiment, the modulation section 5B generates transmission signals by ASK (Amplitude Shift Keying) modulation. Meanwhile, as a modulation method of the transmission signals, it is not limited to the above-mentioned ASK modulation, and it is all right even if another digital modulation method such as FSK (Frequency Shift Keying) modulation and PSK (Phase Shift Keying) modulation is adopted. The power amplification section 5C is a block which carries out amplification of the transmission signals.

In addition, the amplification section 5D is a block which carries out amplification of reception signals received by the reception antenna 4. The frequency conversion section 5E is a block which carries out processing for converting the reception signals into low frequency signals by converting frequency of the reception signals amplified in the amplification section 5D.

In addition, the frequency control section 5F is a block which controls frequency of carrier signals set up by the PLL section 5A. The transmission control section 5G is a block which inputs data for modulating the transmission signals, to the modulation section 5B. The reception control section 5H is a block which carries out processing for receiving distance information calculated by the distance calculation section 6B.

In addition, in the position measurement section 6, the phase information acquiring section 6A is a block which detects a change amount of a phase of reception signal which were frequency-converted by the frequency conversion section 5E, and acquires this as phase change amount information. Meanwhile, the phase change amount information of the reception signals indicates a phase change amount which occurs by such a matter that the reception signals are propagated on a predetermined distance.

More specifically, in a case that the carrier signals outputted from the PLL section 5A is $\sin 2\pi f1t$, the frequency conversion section 5E transfers a value ($D(t)A \cos \phi$) obtained by multiplying the carrier signal ($\sin 2\pi f1t$) and the reception signal ($D(t)A \sin(2\pi f1t+\phi)$) inputted from the amplification section 5D. The phase information acquiring section 6A calculates phase change amount $\phi$ based on the value outputted from the frequency conversion section 5E. Herein, t designates time, D(t) designates a base-band signal in case that ASK modulation was carried out in the modulation section 5B, and A designates an amplitude of carrier signals themselves, and $\phi$ designates a phase change amount due to being propagated on the round-trip distance 2*r*, respectively.

The distance calculation section 6B is a block which calculates a distance between the RFID tag 1 and the reader/writer 2, on the basis of the phase change amount information acquired by the phase information acquiring section 6A. One example of a calculation method of this distance will be hereinafter explained with reference to FIGS. 4(*a*) through 4(*b*) and 5.

(Detail of Distance Measurement)

In this embodiment, it is configured in such a manner that the reader/writer 2 transmits a R/W request signal (request signal) to the RFID tag 1, and the RFID tag 1 returns a response signal (reflected signal), in response to this. This appearance is shown in FIGS. 4(*a*) through 4(*b*).

Figure 4:
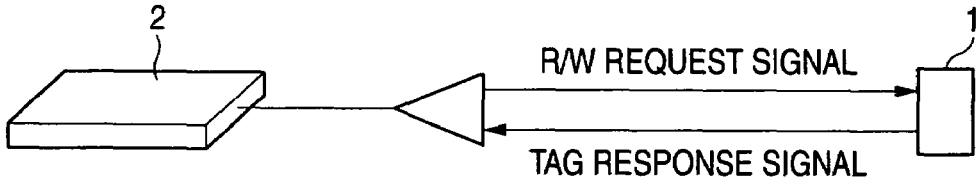
FIG. 4(*a*) is a view which shows such a situation that transmission/reception of a R/W request signal and a tag response signal is carried out between the reader/writer and the RFID tag.
Figure 4:
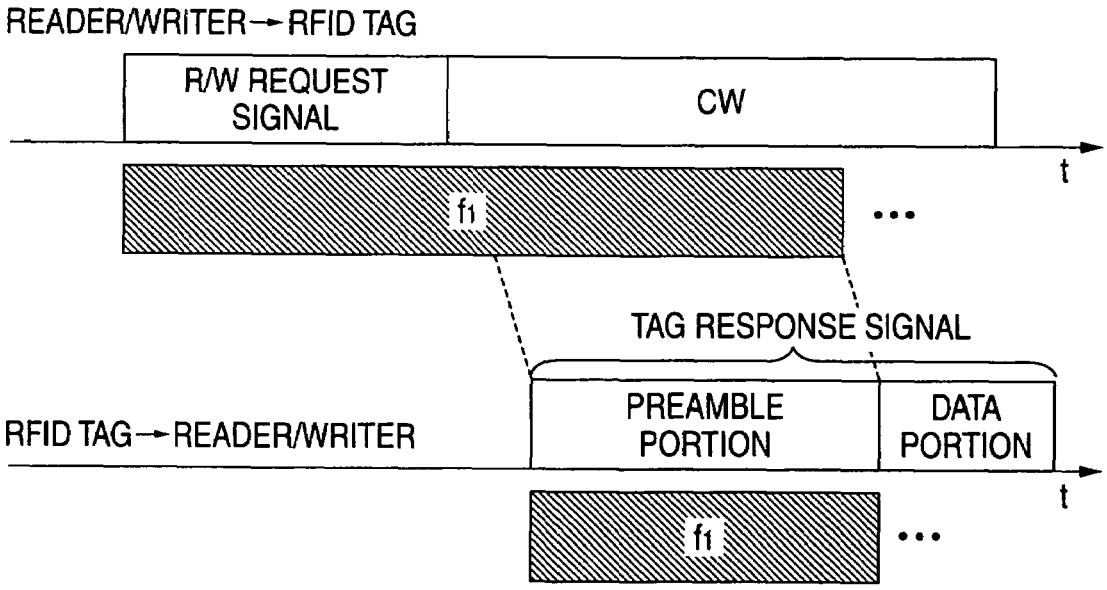

The reader/writer 2 is always transmitting a specific signal (signal for supplying power to the RFID tag 1), whereas transmits the R/W request signal which requests for return of the tag response signal, at the time of requesting the RFID tag 1 to transmit the response signal (hereinafter referred as tag response signal), as shown in FIG. 4(*b*).

That is, the transmission control section 5G in the reader/writer 2 controls the modulation section 5B so as to transmit data which shows a steady state, in the steady state, and, on the occasion of requesting form the tag response signal, controls the modulation section 5B so as to transmit data which configures the R/W request signal.

The RFID tag 1 always monitors signals coming from the reader/writer 2, and when it detects that it has received the R/W request signal, it transmits the tag response signal in the form of responding to it.

More specifically, the reader/writer 2 transmits a signal of one frame composed of the R/W request signal and CW (continuous carrier wave). The RFID tag 1 receives the R/W request signal and CW (continuous carrier wave), and transmits the tag response signal by the carrier frequency f1 corresponding to the frequency of the CW(continuous carrier wave) to the reader/writer 2. In FIG. 4(*b*), the R/W request signal and the CW (continuous carrier wave) are transmitted by the carrier frequency f1, and the tag response signal is transmitted by the carrier frequency f1 in response to the R/W request signal.

The tag response signal is configured by a preamble portion and a data portion, as shown in FIG. 4(*b*). The preamble portion shows data showing a beginning of the tag response signal, and becomes predetermined data which is common to all RFID tag 1, if it falls under the same standard (e.g., ISO/IEC 180000-6). The data portion is a thing which is transmitted in succession to the preamble portion, and shows data showing substantial information that is transmitted from the RFID tag 1. As information which is included in this data portion, for example, ID information, which is unique to each RFID tag 1, and so on are cited, but it is all right even if information to be transmitted from the RFID tag 1, e.g., various information stored in a storage section in the RFID tag 1, and so on are included.

Then, the reader/writer 2 transmits the R/W request signal twice, and differentiates carrier frequency in transmission of each R/W request signal (more specifically, carrier frequency in transmission of each CW (continuous carrier wave) following the R/W request signal), each other. That is, the frequency control section 5F in the reader/writer 2 controls the PLL section 5A so as to output carrier signals with first frequency f1, at the time of transmitting a first time R/W request signal, and controls the PLL section 5A so as to output carrier signals with second frequency f2, which is different from the first frequency f1, at the time of transmitting a second R/W request signal.

Figure 3:
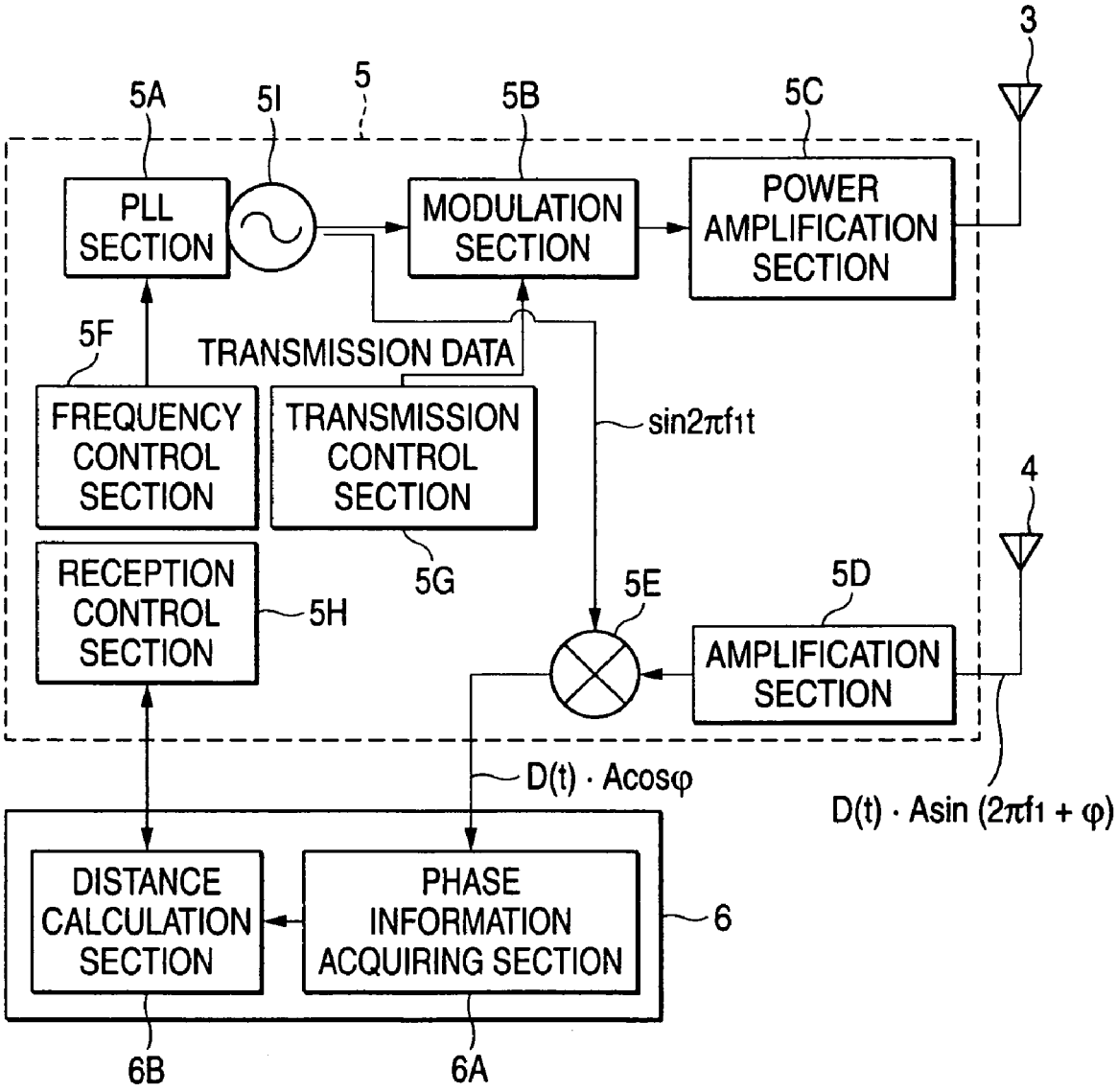
FIG. 3 is a block diagram which shows, in a reader/writer which the monitor system, that relates to this embodiment, is equipped with, an outline of a configuration for measuring a distance between a RFID tag and the reader/writer.

As shown in FIGS. 3 and 4, when the RFID tag 1 receives the R/W request signal transmitted with the first frequency f1, the tag response signal is returned with the same first frequency f1. Then, in the reader/writer 2, the phase information acquiring section 6A analyzes the preamble portion of the received tag response signal, and thereby, detects $\phi$1 which shows a phase change amount of the tag response signal. In the same manner, when the RFID tag 1 receives the R/W request signal transmitted with the first frequency f2, the tag response signal is returned with the same second frequency f2. Then, in the reader/writer 2, the phase information acquiring section 6A analyzes the preamble portion of the received tag response signal, and thereby, detects $\phi$2 which shows a phase change amount of the tag response signal.

Meanwhile, in the above-described example, it is configured in such a manner that a phase change amount of the tag response signal is detected by analyzing the preamble portion, but it is not limited to this, and it is all right even if a phase change amount is detected including the data portion, and it is also all right even if a phase change amount is detected in the data portion. In this regard, however, in case that a modulation method is PSK, it becomes difficult to detect a phase change amount which goes with a distance, on the basis of the data portion whose content can be changed, and therefore, it is desirable to detect a phase change amount in the preamble portion whose content is fixed.

In addition, the above-mentioned reader/writer 2 is set up so as to carry out detection of this phase change amount, every 50 msec in this embodiment. That is, the reader/writer 2 is configured so as to transmit the R/W request to the RFID tag 1 signal twice at intervals of 50 msec. Meanwhile, detection timing of this phase change amount is not limited to the 50 msec interval, and it may be a much shorter time interval, and further, it may be a much longer time interval. It is desirable to decide it appropriately, depending on moving speed of an article and a range where the reader/writer 2 can communicate.

In this manner, when the phase information acquiring section 6A detects the phase change amounts $\phi$1 and $\phi$2, information of these phase change amounts is transferred to the distance calculation section 6B. The distance calculation section 6B calculates a distance between the RFID tag and the reader/writer 2, on the basis of $\phi$1 and $\phi$2, as described below.

Firstly, assuming that a distance from the reception antenna 4 to the RFID tag 1 and a distance from the transmission antenna 3 to the RFID tag 1 is a distance r, the phase change amounts $\phi$1 and $\phi$2, which occur due to such a matter that signals, which are carried with the first frequency f1 and the second frequency f2, are propagated on a round-trip distance 2*r*, are represented by the following formula.

$$\phi_1 = \frac{2\pi \cdot f_1}{c} \cdot 2r, \quad \phi_2 = \frac{2\pi \cdot f_2}{c} \cdot 2r \qquad \text{[Mathematical Formula 1]}$$

In the above-mentioned formula, c represent velocity of light. On the basis of the above-mentioned two formulas, the distance r is obtained by the following formula.

$$r = \frac{c \cdot \Delta\phi}{4\pi \cdot |f_1 - f_2|} \qquad \text{[Mathematical Formula 2]}$$

$$\because \Delta\phi = \phi_1 - \phi_2$$

By doing as described above, it is possible to obtain the distance r from the transmission antenna 3 to the RFID tag 1, on the basis of the phase change amounts $\phi$1 and $\phi$2. Meanwhile, in the RFID tag 1, it is expected that there occurs phase displacement during a period from the R/W request signal being received until the tag response signal being transmitted, but this phase displacement becomes the same amount in any one of signals which are carried with the first frequency f1 and the second frequency f2. Thus, there is no such a case that phase displacement, which occurs at the time of transmitting/receiving signals in the RFID tag 1, exerts an influence on the above-mentioned calculation of the distance.

In addition, as described above, the reader/writer 2 is of such a configuration that it transmits the R/W request signal to the RFID tag 1 twice at intervals of 50 msec. On this account, the reader/writer 2 can measure a distance between the RFID tag 1 and its own device, every 50 msec.

Meanwhile, in the mathematical formula 2, in case that $\Delta\phi$ becomes 2 $\pi$ or more, it is not possible to calculate the distance r accurately. That is, a measurable maximum value of the distance r is at the time of $\Delta\phi=2\pi$, and it is represented by the following formula.

$$r\max = \frac{c}{2 \cdot |f_1 - f_2|} \qquad \text{[Mathematical Formula 3]}$$

Here, for example, in case of assuming that a difference of the first frequency f1 and the second frequency f2 is 5 MHz, the maximum distance rmas becomes 30 m by the mathematical formula 3. In addition, in the same manner, in case of assuming that a difference of the first frequency f1 and the second frequency f2 is 2 MHz, the maximum distance rmas becomes 75 m by the mathematical formula 3. In case of utilizing the UHF band, an envisioned maximum communication distance is approximately 10 m, and therefore, it is recognized that measurement as described above does not have a problem from a practical viewpoint.

Meanwhile, in case that a width of the gate, through which a user enters and leaves, becomes large and measurement of the above-mentioned maximum distance rmax or more becomes necessary, it is possible to carry out measurement of the distance r, for example by using measurement of reception strength of reception signals, at the same time.

Concretely speaking, in case that there is such a possibility that $\Delta\phi$ becomes 2 $\pi$ or more, a candidate r' of the distance r becomes r'=r+n.rmax (n is an integer of 0 or more). Thus, it becomes possible to specify a value of the above-mentioned n, by utilizing such a matter that the reception strength of reception signals becomes smaller as the distance r becomes longer.

Meanwhile, the measuring method, which is shown in the above-described "Configuration regarding Distance Measurement" and "Detail of Distance Measurement" is one example for measuring a distance between the reader/writer 2 and the RFID tag 1, and a configuration of the reader/writer 2, which relates to this embodiment, is not limited to this. That is, it is all right if the above-mentioned reader/writer 2 is of such a configuration that it is possible to measure a distance of its own device and the RFID tag 1, from signals received from the RFID tag 1.

In addition, in case of using an active type RFID tag, it is all right even if it is configured so as to carry out measurement of a distance, on the basis of a tag response signal which is actively sent from the side of the RFID tag 1, without transmitting the R/W request signal from the side of the reader/writer 2.

Figure 5:
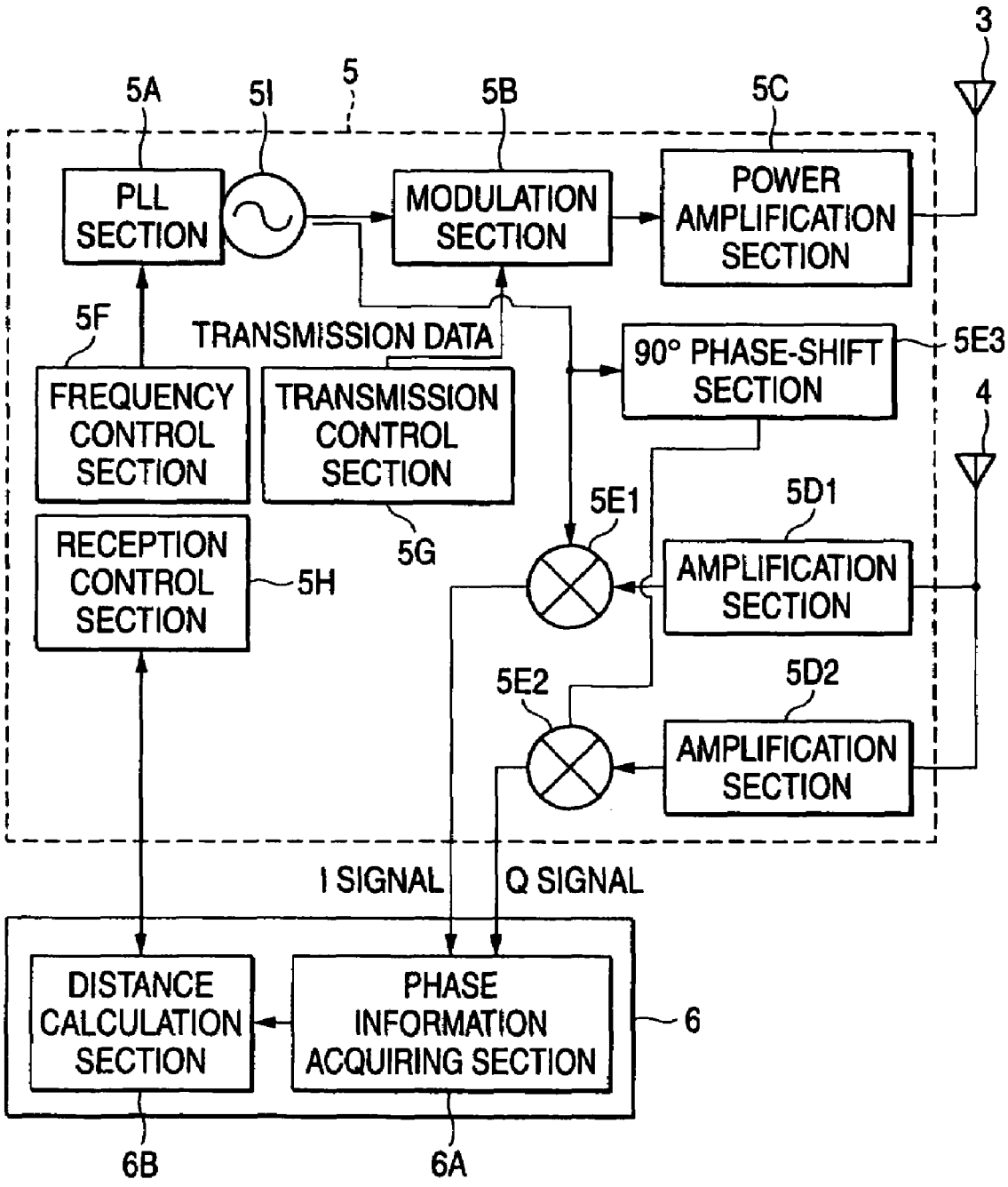
FIG. 5 is a block diagram which shows a schematic configuration of the reader/writer including a concrete configuration of a reception processing section which enables to carry out phase detection.

In the above-described distance measurement, processing of detecting a phase of reception signals is carried out, but a concrete configuration for enabling to carry out detection of this phase change amount will be hereinafter described over referring to FIG. 5. In this concrete example, the communication processing section 5 becomes a thing which enables detection processing of a phase change amount in the position measurement section 6, by separating reception signals into I signals and Q signals and inputting them to the position measurement section 6. As shown in the same figure, the communication processing section 5 is equipped with two amplifier sections 5D1/5D2 as the amplification section 5D, mixers 5E1/5E2 as the frequency conversion section 5E, and a 90° phase-shift section 5E3.

Reception signals, which are received by the reception antenna 4, are bifurcated into two routes, and one is inputted to the amplification section 5D1, and the other is inputted to the amplification section 5D2. The amplification section 5D1 amplifies the inputted reception signals and inputs them to the mixer 5El. The amplification section 5D2 amplifies the inputted reception signals and inputs them to the mixer 5E2.

The mixer 5E1 outputs the I signals by mixing the reception signals inputted from the amplification section 5D1, and carrier signals outputted from the PLL section 5A, and inputs this I signal to the phase information acquiring section 6A. The mixer 5E2 outputs the Q signals by mixing the reception signals inputted from the amplification section 5D2, and carrier signals outputted from the PLL section 5A and 90°-phase changed through the 90° phase-shift section 5E3, and inputs this Qsignal to the phase information acquiring section 6A.

Details of reception processing and calculation processing of the distance r, which are carried out in the above-described configuration, will be hereinafter explained.

Signals, which are propagated on a round-trip distance 2*r* and received by the reader/writer 2, are represented by the following formula, assuming that frequency of the carrier signals is set to f1.

$$s_1(t)=D(t)\cdot A\ \sin(2\pi f_1 t+\phi_1) \qquad \text{[Mathematical Formula 4]}$$

In the above formula, t designates time, and s1 (t) designates a situation of signals conveyed with carrier signals of frequency f1, and D(t) designates a base-band signal in case that ASK modulation was carried out in the modulation section 5B, and A designates an amplitude of carrier signals themselves, and ϕ1 designates a phase change amount due to being propagated on the round-trip distance 2*r*, respectively. In this case, I1(t) which shows a situation of the I signals outputted by the mixer 5E1, and Q1 (t) which shows a situation of the Q signals outputted by the mixer 5E2 are represented by the following formulas.

$$I_1(t)=D(t)\cdot A\ \sin(2\pi f_1 t+\phi_1)\cdot\sin 2\pi f_1 t \Rightarrow D(t)\cdot A\ \cos\phi_1 \qquad \text{[Mathematical Formula 5]}$$

$$Q_1(t)=D(t)\cdot A\ \sin(2\pi f_1 t+\phi_1)\cdot\cos 2\pi f_1 t \Rightarrow D(t)\cdot A\ \sin\phi_1 \qquad \text{[Mathematical Formula 6]}$$

By the foregoing, the phase change amount ϕ1 of signals by carrier signals of frequency f1 is represented by the following formula, on the basis of the I signals and the Q signals.

$$\phi_1=\tan^{-1}\frac{Q_1(t)}{I_1(t)} \qquad \text{[Mathematical Formula 7]}$$

In the same manner, the phase change amount ϕ2 of signals by carrier signals of frequency f2 is represented by the following formula.

$$\phi_2=\tan^{-1}\frac{Q_2(t)}{I_2(t)} \qquad \text{[Mathematical Formula 8]}$$

By doing as above, the phase information acquiring section 6A acquires the phase change amounts ϕ1 and ϕ2 on the basis of the inputted I signals and Q signals. Then, the distance calculation section 6B calculates the distance r by the following formula.

$$r=\frac{c\cdot\Delta\phi}{4\pi|f_1-f_2|} \qquad \text{[Mathematical Formula 9]}$$

$$\because \Delta\phi=\phi_1-\phi_2$$

(Flow of Distance Measurement Processing)

Figure 6:
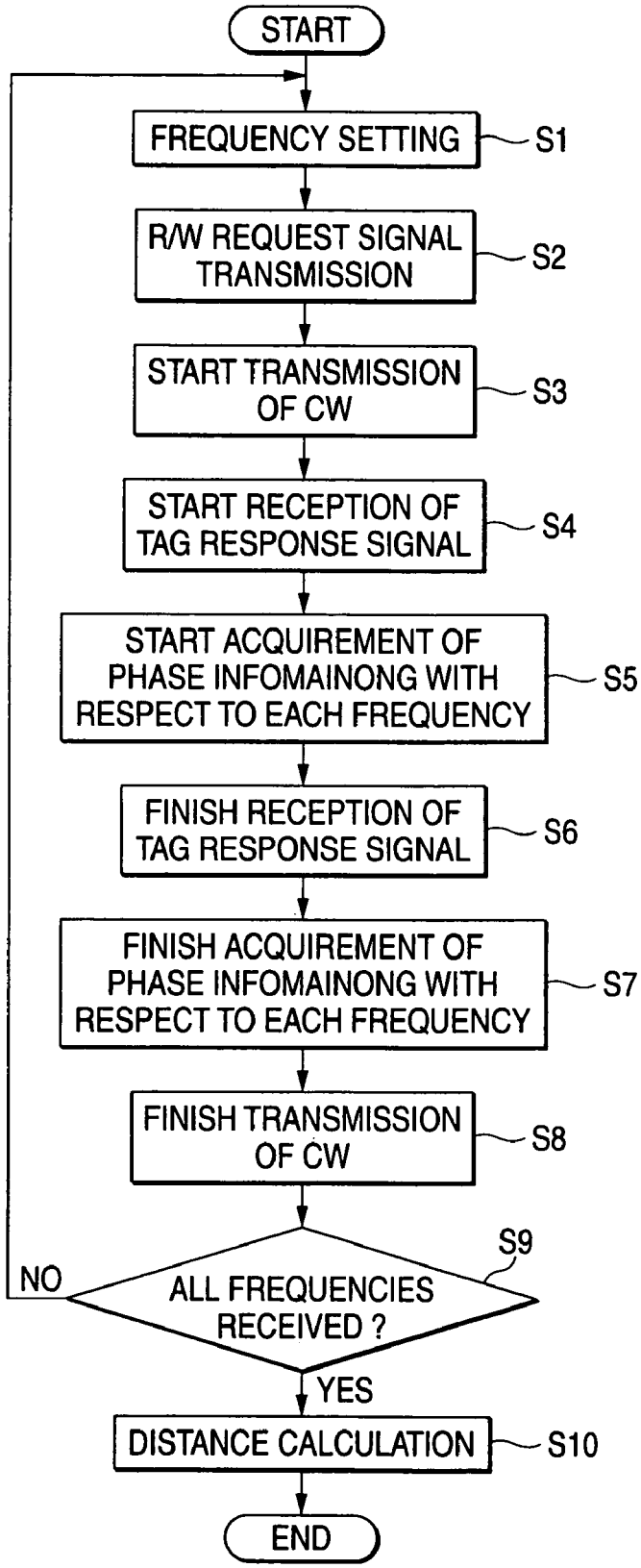
FIG. 6 is a flow chart which shows a flow of distance measurement processing.

Next, a flow of the above-mentioned distance measurement processing in the reader/writer 2 will be explained over referring to a flow chart shown in FIG. 6.

Firstly, when distance measurement processing is started, in a step 1 (hereinafter, referred to as S1), the frequency control section 5F controls the PLL section 5A so that the frequency of carrier signals on the occasion of transmitting the R/W request signal becomes the first frequency f1 (S1).

Next, the transmission control section 5G controls the modulation section 5B so as to have data showing the R/W request signal overlapped with carrier signals. Then, transmission signals, which were modulated by the modulation section 5B, are outputted from the transmission antenna 3 after they were amplified by the power amplifier section 5C (S2).

Then, the CW (continuous carrier wave) which follows the R/W request signal is transmitted by the first frequency f1 (S3).

When the RFID tag 1 detects the R/W request signal, the RFID tag 1 transmits the tag response signal by the carrier frequency corresponding to the first frequency f1 of the CW (continuous carrier wave) detected after the R/W request signal. When the reception antenna 4 receives this tag response signal, the communication processing section 5 carries out the reception processing (S4), and then the phase information acquiring section 6A carries out the phase information acquiring processing (S5).

More specifically, in the communication processing section 5, the frequency conversion section 5E calculated the I signals and Q signals by mixing the reception signal inputted from the amplification section 5D and the carrier signals outputted by the PLL section 5A based on the above-mentioned mathematical formulas 4 to 6. The phase information acquiring section 6A receives the I signals and Q signals from the frequency conversion section 5E, then calculates the phase change amount ϕ1 and ϕ2 based on the mathematical formulas 7 to 8, and forms and stores a table listing the calculated phase change amount ϕ1 and ϕ2 associated with the frequency used as the carrier signal (the first frequency f1).

After the reception of the tag response signal from the RFID tag 1 is completed in the communication processing section 5 (S6), the phase information acquiring section 6A finishes the phase information acquiring processing (S7). After that, the communication processing section 5 finishes the transmission of CW (continuous carrier wave), that is, the transmission of the signal of one frame (S8).

After that, the reception control section 5H judges whether or not it received reception signals of all frequencies to be received, and in case that it was judged that it has not received all (NO in S9), it goes back to processing from S1. Here, in the above-mentioned example, first and second frequencies are assumed as frequency of reception signals, and therefore, the reception control section 5H is to judge whether or not it has received both reception signals of first and second frequencies.

At this time point, it receives only reception signals of first frequency, and therefore processing from S1 is to be carried out. Then, in processing of second time S1, the frequency control section 5F controls the PLL section 5A so that frequency of carrier signal on the occasion of transmitting the R/W request signal becomes second frequency. After that, processing of S2 to S9 is carried out, and it is judged that it received reception signals of all frequencies to be received (YES in S9), and it is moved to processing of S10.

In S10, the distance calculation section 6B calculated a distance between the RFID tag 1 and the reader/writer 2, on the basis of the acquired phase information, by the above-described method. More specifically, the distance calculation section 6B takes out the phase change amount for each frequency from the table, and calculates the distance r based on the above-mentioned mathematical formula 9. The calculated distance information is conveyed to the reception control section 5H. By the foregoing, distance measurement processing is completed.

(Configuration of Monitor Device)

Next, a configuration of the monitor device 10, which relates to this embodiment, will be explained with reference to FIG. 1, again.

As shown in FIG. 1, the above-mentioned monitor device 10 is configured so as to be equipped with an external communication section (reception section) 11, an information extraction section (reception section) 12, a room entering/leaving monitor section (entering/leaving judgment section) 13, a specifying section (specifying section) 14, a certification judgment section (advisability judgment section) 15, an output instruction means (output section) 16, and an information storage section (a history recording device, a combination information storage device) 17.

The external communication section 11 is a block which receives information of the RFID tag 1 that was read out in the reader/writer 2, and transmits information of instructing the reader/writer 2 for writing to the RFID tag 1. The external communication section 11 transmits the information received from the reader/writer 2, to the information extraction section 12. In addition, the external communication section 11 carries out the information for instructing for writing, depending on the instruction from the output instruction section 16.

The information extraction section 12 is a thing which extracts distance information of the RFID tag 1 (a distance between the RFID tag 1 and the reader/writer 2), out of information received from the reader/writer 2 through the external communication section 11. This information extraction section 12 stores the extracted distance information in the information storage section 17.

That is, in this embodiment as described above, it is configured in such a manner that the reader/writer 2 calculates a distance between its own device and the RFID tag 1, at very short time intervals such as 50 msec, on a steady basis. In addition, in a response signal acquired from the RFID tag 1, as described above, ID information, which is unique to each RFID tag 1 (which includes article ID in case of the RFID tag 1*a*, and user ID in case of the RFID tag 1*b*), is included.

There, the above-mentioned information extraction section 12 records a history of distance information with respect to each RFID tag 1, in the information storage section 17, depending on ID information allocated to the received distance information. In sum, this information extraction section 12 records distance information of the RFID tag 1*a*, as second history information 19, and records distance information of the RFID tag 1*b*, as first history information 18, in the information storage section 17.

Meanwhile, a reception section is realized by the above-mentioned external communication section 11 and information extraction section 12.

In this embodiment, as to the above-mentioned first history information 18, distance information, which corresponds to each user ID, is recorded with respect to each time when the distance information was calculated, for example as shown in FIG. 7(*a*). In addition, as to the second history information 19, distance information, which corresponds to each article ID, is recorded with respect to each time when the distance information was calculated.

Meanwhile, in this embodiment, it is of such a configuration that histories of distance information up to the RFID tag 1*a* or the RFID tag 1*b* are is classified into the first history information 18 and the second history information 19, respectively and they are managed separately, but it may be of such a configuration that they are managed as one history information. That is, user ID or article ID is associated with a history of each distance information. On this account, the monitor device 10 can specify that a history of recorded distance information shows distance information to the RFID tag 1 which was equipped with which user or article, in case that the first history information 18 and the second history information 19 are stored in the information storage section 17 as one history information.

The room entering/leaving monitor section 13 is a thing which monitor entering/leaving of a user, who is equipped with this RFID tag 1*b*, in/from the safekeeping room 100, with reference to the first history information 18 recorded in the information storage section 17. Concretely speaking, this room entering/leaving monitor section 13 judges such timing that the above-mentioned user enters in or leave from a room. Then, the room entering/leaving monitor section 13 notifies this judged result to the specifying section 14.

In sum, in this embodiment, the above-mentioned room entering/leaving monitor section 13 is configured so as to confirm the first history information recorded in the information storage section 17 periodically. Then, the above-mentioned room entering/leaving monitor section 13 monitors displacement of the RFID tag 1*b* which is equipped with a user, with reference to the first history information 18.

Here, monitoring of the displacement of the RFID tag 1*b* is to confirm a change amount of distance information per predetermined time, etc., and to specify timing of room leaving. Meanwhile, details about judgment processing at the time of room leaving of a user who was equipped with the RFID tag 1*b* in this safekeeping room 100 will be described later.

The specifying section 14, when it receives judgment showing room-leaving of a user from the room entering/leaving monitor section 13, specifies an article which is taken out by a user who was judged to have left from a room, with reference to the first history information 18 and the second history information 19 recorded in the information storage section 17. That is, the above-mentioned specifying section 14 specifies a combination of the RFID tag 1*b* of a user who passes through the gate 80 and leaves from a room, and the RFID tag 1*a* of an article. Then, the specifying section 14 notifies the specified combination to the certification judgment section 15.

The certification judgment section 15 judges whether a user has such authority that the user can leave from a room with having this article, with reference to certification information 20, in a combination of a user and an article which were judged to have left from a room, on the basis of a judgment result received from the specifying section 14. That is, in this embodiment, an article which can be taken out from the safekeeping room 10, and an article which can not be taken out, have been decided, with respect to each user. Then, in the above-mentioned certification information 20, information, which shows whether room-leaving is permitted or not, is recorded, in a corresponding relation of a user (user ID) and an article (article ID), for example, as shown in FIG. 8. Meanwhile, the certification information 20 is not a thing which is limited to information shown in FIG. 8, and is set up appropriately, depending on a content which is desired to restrict entering/leaving in/from the safekeeping room 100.

The output instruction section 16 is a thing which displays a judgment result by the certification judgment section 15, on a display device 21, depending on a notification from the certification judgment section 15. Meanwhile, in this embodiment, it is of such a configuration that it is possible to show whether taking-out of an article by a user is appropriate or not, or whether room-entering of a user who had an article is appropriate or not, to a manager of the monitor system 90 which relates to this embodiment, by displaying a notification from the certification judgment section 15 on the display device 21.

However, a method of submitting it to a manager is not limited to this, but for example, it is all right even if it is carried out by a sound, and it is all right even if it is of such a configuration that it is carried out by lighting of a display lamp etc. For example, in case of a submitting method by a sound, it is realized by such a matter that the monitor system 90 is equipped with a speaker in lieu of the above-mentioned display device 21, and the output instruction section 16 converts output data so as for a user to be able to recognize it as a sound, and outputs it to the speaker.

(Judgment Processing of Room Entering/Leaving)

Next, with reference to FIGS. 9(*a*), 9(*b*), 10 and 11, judgment processing of room entering/leaving of a user and an article respectively in the monitor system 90 which relates to this embodiment, will be explained.

Firstly, as a premise, in the monitor system 90 which relates to this embodiment, the reception antenna 4 has a directional characteristic, and is disposed so as to be able to communication with only the RFID tag 1 which exists in a predetermined region in the safekeeping room 100. That is, communication of the reception antenna 4 is configured so as to be limited to a distance range where the reception antenna 4 can communicate, as the predetermined region in the safekeeping room 100, as shown in FIGS. 9(*a*) and 9(*b*).

Meanwhile, in this embodiment, a gate passage judgment range is disposed as a standard for confirming entering/leaving of a user who is equipped with the RFID tag 1*b*, and an article with which the RFID tag 1*a* is equipped. Then, the monitor device 10 has stored information, which shows a maximum distance and a minimum distance between this gate passage judgment range and the reception antenna 4, in advance.

This gate passage judgment range is a position range for judging whether a user entered in/left from the safekeeping room 100 or not, and is a region which a user, who enters/leaves in/from the gate, passes through. In this embodiment, as shown in FIGS. 9(*a*) and 9(*b*), it is a range which becomes nearly perpendicular to a floor surface in the safekeeping room 100 in up and down directions, and which is connected to a forefront of the reception antenna 4, and further, a range in a direction of becoming parallel to the gate 80, on a horizontal surface which crosses the up and down directions nearly perpendicularly.

Meanwhile, the information, which shows the maximum distance and the minimum distance between the gate passage judgment range and the reception antenna 4, (not shown in the figure) is referred to passage judgment distance information, here.

Figure 9:
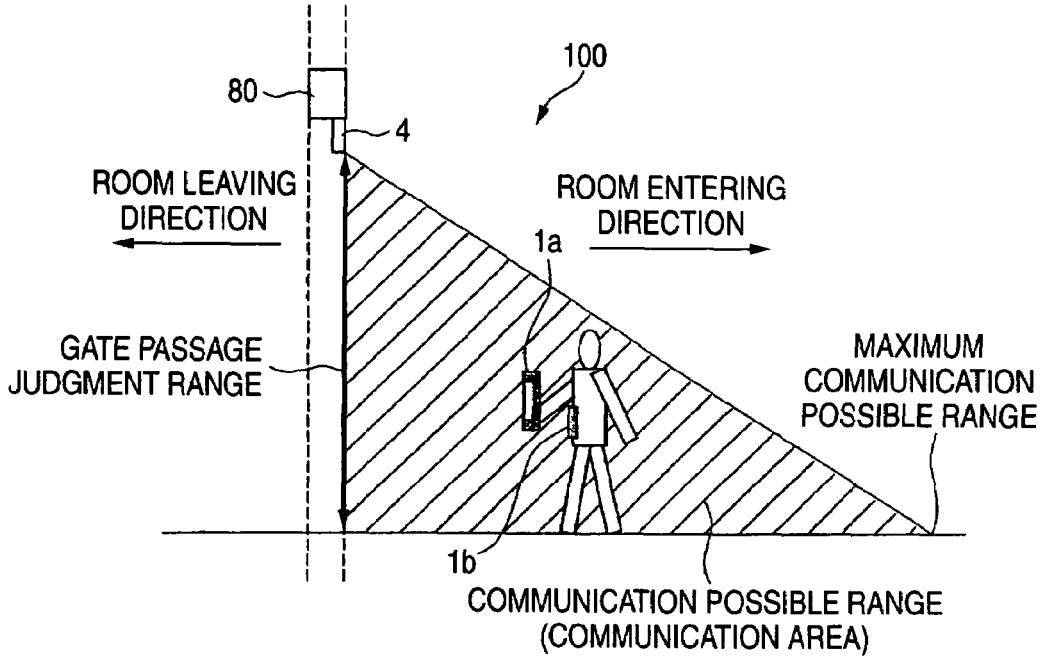
FIG. 9 is a view which schematically shows one example of a range where the reader/writer, that relates to this embodiment, can communicate, and a position relation between a user and an article, and the same figure (a) is a side view of a space in a predetermined region of a safekeeping room, and the same figure (b) is a plan view of the space in the predetermined region of the safekeeping room.
Figure 9:
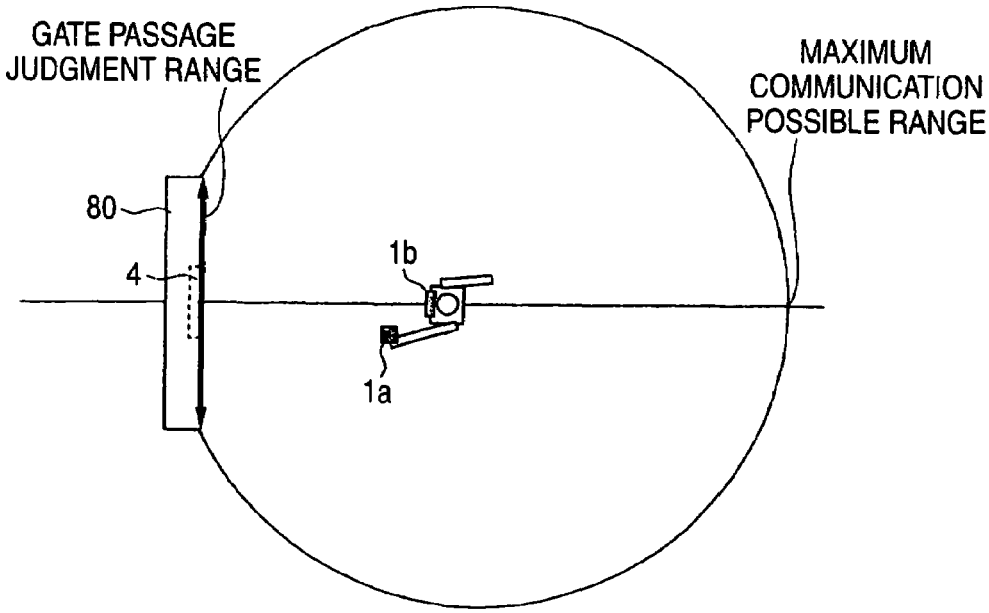

In this manner, the reception antenna 4, which relates to this embodiment, is configured so as to be able to receive only signals from the RFID tag 1 which exists in the predetermined region of the safekeeping room 100. Meanwhile, this FIG. 9 is a view which schematically shows one example of a position relation of the range where the reader/writer can communicate (communication area) which relates to this embodiment, and a user and an article, and the same figure (a) is a side view of a space in the predetermined region of the safekeeping room 100, and the same figure (b) is a plan view of the space in the predetermined region of the safekeeping room 100.

mean while, a mounting position of the reception antenna 4 is not limited to a position shown in FIGS. 9(*a*) and 9(*b*). For example, it is all right even if this mounting position of the reception antenna 4 is headed for such a direction that a room leaving direction side is set as a communication area. In case that the reception antenna 4 is mounted in this manner, the reception antenna 4 has become capable of receiving only signals from the RFID tag 1 which exists outside the safekeeping room 100.

In sum, as to the reception antenna 4 which the reader/writer 2 relating to this embodiment is equipped with, it is all right if it is configured so as to be able to receive only signals from the RFID tag 1 which exists in at least any one region of the side of the safekeeping room 100 or the outside of the safekeeping room 100.

In the above-mentioned premise, the monitor system 90, which relates to this embodiment, can specify a combination of a user and an article which enter/leave in/from the safekeeping room 100.

Firstly, in the monitor system 90, the reader/writer 2 carries out detection processing of the RFID tag 1 (RFID tag 1*a* and/or RFID tag 1*b*) (S11).

In this embodiment, it is configured in such a manner that the reader/writer 2 transmits, by broadcast, the R/W request signal (request signal) to the RFID tags 1*b* . . . which exist in the communication area, and receives the tag response signal, from each of the RFID tags 1*b*, in response to this signal. Meanwhile, at this time, if the RFID tags 1*a* . . . , which are equipped with articles, also exits in the communication area of the reader/writer 2, they return response signals in the same manner as the RFID tags 1*b* . . .

then, the reader/writer 2 has transmitted request signals at predetermined time intervals, and can receive response signals of the RFID tags 1*b* . . . and the RFID tags 1*a* . . . in the above-described manner, on the occasion that each of users equipped with the RFID tags 1*b* has reached to an inside of the communication area of the reader/writer 2.

Then, in case that the reader/writer 2 received a response signal which corresponds to this request signal, the monitor device 10 judges that it detected the RFID tag 1 which transmitted the response signal ("YES" in S12).

Inversely, in case that the reader/writer 2 did not receive a return of the response signal which corresponds to this request signal, the monitor device 10 judges that there is no detection of the RFID tag 1 ("NO" in S12).

Here, in the reader/writer 2, when it receives a response signal from each of the RFID tag 1*a* and/or the RFID tag 1*b* ("YES" in S12), the communication processing section 5 reads out information which has been stored in a storage section of each of the RFID tag 1*a* and/or the RFID tag 1*b*, on the basis of these response signals (S13). That is, the reader/writer 2 reads out article information from the RFID tag 1*a*, and user information from the RFID tag 1*b*.

In addition, the reader/writer 2, when it carries out reading of the above-mentioned article information and/or user information, calculates of a distance to each RFID tag 1 detected by the reader/writer 2, respectively (S14).

That is, as described above, the reader/writer 2 transmits a request signal twice to each of the RFID tag 1, by carrier frequencies which are different from each other. Then, in the reader/writer 2, it detects each of a phase change amount of a response signal returned from the RFID tag 1, depending on each of these request signals, and on the basis of information of this phase change amount, the position measurement section 6 calculates a distance between each RFID tag 1 and the reader/writer 2. Then, distance information, which was calculated by the position measurement section 6, is transmitted to the monitor device 10 through the external communication section 7, together with read-out information of each RFID tag 1.

On the one hand, in the monitor device 10, information of each RFID tag 1 is received by the reader/writer 2 through the external communication section 11, and then, the information extraction section 12 extracts distance information out of information received through the above-mentioned external communication section 11, and stores it as history information, in the information storage section 17 (S15)

Meanwhile, in this embodiment, distance information, which was extracted from information received from the RFID tag 1*a*, is stored in the information storage section 17 as the second history information 19. On the one hand, distance information, which was extracted from information received from the RFID tag 1*b*, is stored in the information storage section 17 as the first history information 18. In this manner, in the monitor device 10, it acquires respective distance information of the RFID tags 1*a*/1*b*, and can record each of the first history information 18 and second history information 19, in the information storage section 17.

Here, in case that distance information has been already stored as the first history information 18 or the second history information 19 more than once, the information extraction section 12 associates the distance information calculated this time with distance information calculated in the past, and adds it to the first history information 18, or the second history information 19, and stores it in the information storage section 17.

On the one hand, in case of having, first this time, acquired distance information from the RFID tag 1*a* or the RFID tag 1*b*, a history relating to distance information of the RFID tag 1*a* or the RFID tag 1*b* (first history information 18, second history information 19) has not yet existed, in the information storage section 17. In this case, in the monitor system 90, distance of a detected RFID tag 1 is stored in the information storage section 17, as new first history information 18 or second history information 19, and detection processing of this RFID tag 1 is to be continued again at predetermined time intervals.

By doing as above, in the monitor system 90 which relates to this embodiment, detection processing to the RFID tag 1 is carried out at predetermined time intervals, and it is possible to store history information of the detected RFID tag 1 in the information storage section 17.

Next, in the monitor system 90, the monitor device 10 confirms presence or absence of history information which became undetected, among history information of the RFID tag 1*b* (first history information 18 . . . ) (S16). That is, in the above-mentioned monitor device 10, it is configured in such a manner that the room entering/leaving monitor section 13 monitors the first history information 18 . . . stored in the information storage section 17 at predetermined time intervals. Then, the room entering/leaving monitor section 13 monitors whether the RFID tag 1*b*, for which recording of the first history information 18 became stopped, does not exist, in the first history information 18 . . . recorded in the information storage section 17.

Meanwhile, processing of this step S16 is carried out regardless of presence or absence of detection of the RFID tag 1 in the above-mentioned step S12. This is because there is such a possibility that an earlier detected RFID tag 1 exits to an outside of the safekeeping room 100 and has become undetected, even in such an any case that there exists the RFID tag 1 which is currently being detected, or there exists no RFID tag 1 which is currently being detected.

Then, in case that there is no history information of the RFID tag 1 which became undetected ("No" in S16), detection processing of the RFID tag 1 is carried out, and distance information from the reader/writer 2 to the RFID tag 1 is calculated, and processing of the above-mentioned steps 12 through 15 for recording it in the information storage section 17 is repeated.

On the one hand, in case that there exists history information of the RFID tag 1 which became undetected ("YES" in S16), room entering/leaving judgment processing of a user equipped with the RFID tag 1*b* which became undetected is carried out.

Concretely speaking, firstly, the above-mentioned room entering/leaving monitor section 13 judges whether a condition 1 is satisfied or not in a relation of a distance to the RFID tag 1*b* and time, on the basis of the first history information 18 of the RFID tag 1*b* which became undetected (S17).

Here, in case of "YES" in the step S17, in a relation of calculated time and distance, a size of a distance at such a time point that recording of distance information was stopped becomes smaller than a size of a distance at the time of recording start. Then, it is a case of satisfying such a condition (condition 1) that a size of a distance at such a time point that recording of distance information was stopped is included in a distance range from the reader/writer 2 to the gate passage judgment range, i.e., a range of passage judgment distance information.

In case of satisfying this condition 1, in the monitor device 10, the room entering/leaving monitor section 13 judges, at such a time point that a user, who is equipped with the RFID tag 1*b*, moves from the safekeeping room 100 toward the gate 80 and the above-mentioned recording was stopped, that this user passed through the gate 80 and left from a room. That is, the room entering/leaving monitor section 13 judges that a user left from a room (S18).

As above, in this embodiment, the reception antenna 4 is disposed on the gate so as to be able to receive only electromagnetic waves from the RFID tag 1 which exists in the predetermined region of the safekeeping room 100. Therefore, in case that a user moves from the safekeeping room 100 toward an outside, the RFID tag 1*b*, which was equipped with a user, is to access to the reader/writer 2 which was disposed on the gate 80, as time advances.

Figure 10:
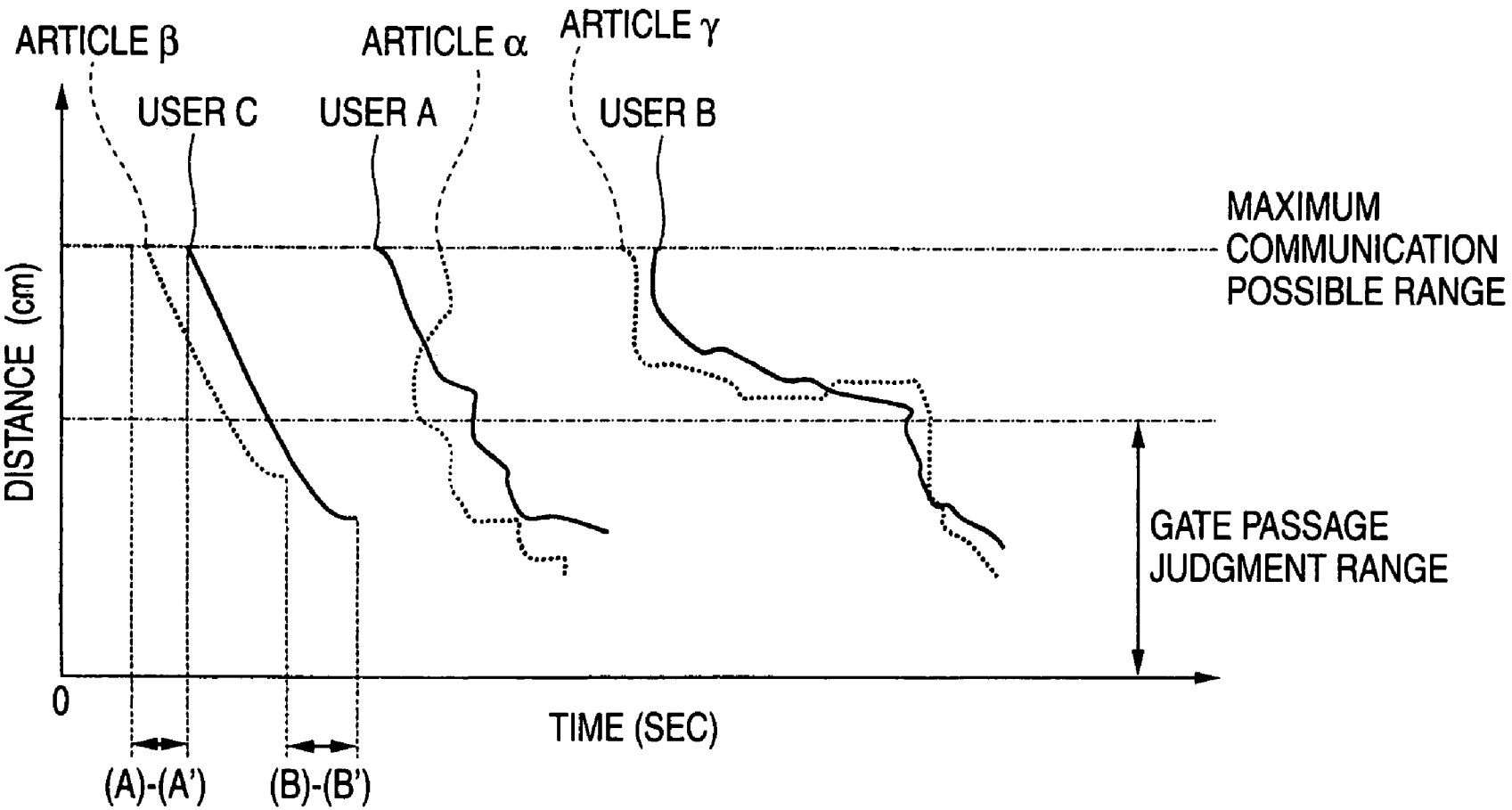
FIG. 10 is a graph which shows one example of a relation of a distance between the reader/writer, that relates to this embodiment and the RFID tag, and time.
Figure 11:
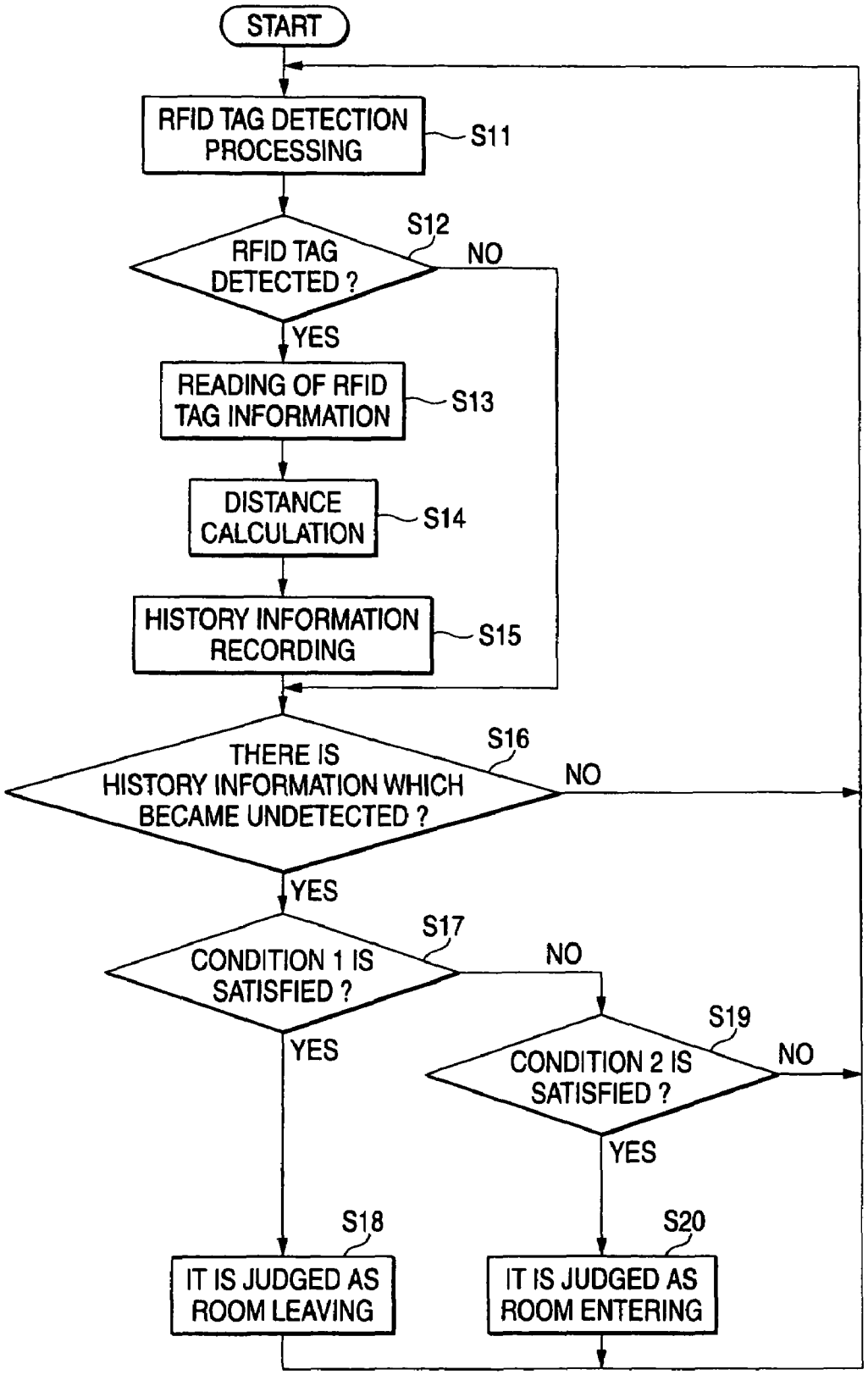
FIG. 11 is a flow chart which shows processing of judgment processing of room entering/leaving, in the monitor system that relates to this embodiment.

On this account, a relation of time and a distance at the time of room-leaving of a user becomes a downward trend, for example as shown in users A, B, C of FIG. 10. Then, for example, at a position of a point (I') in FIG. 10, the user C is to be located nearly right below the reception antenna 4, and it is possible to judge that the user C passed through the gate 80 in this point (I').

Meanwhile, this FIG. 10 is a graph which shows one example of a relation of a distance and time between a reader/writer, which relates to this embodiment, and a RFID tag.

On the one hand, in case of "NO" in the step S17, the room entering/leaving monitor room 13 judges whether a relation of a distance to the RFID tag 1*b* and time satisfies a condition 2 or not (S19). That is, this condition 2 is a case of satisfying such a condition (condition 2) that a size of a distance at the time of recording termination becomes larger than a size of a distance at the time of starting recording of distance information, and a size of a distance at a time point of starting recording of distance information is included in a distance range from the reader/writer 2 to the gate passage judgment range, i.e., a range of passage judgment distance information.

In case of "YES" in judgment of this step S19, the room entering/leaving monitor section 13 judges that a user, who is equipped with the RFID tag 1*b* which has been detected, is moving from the gate 80 to an inside of the safekeeping room 100 (room entering direction), and passed through the gate 80 at a time point of start of the above-mentioned increase. That is, the room entering/leaving monitor section 13 judges that a user, who is equipped with this RFID tag 1*b*, entered in a room (S20).

That is, in this embodiment, the above-mentioned reception antenna 4 was disposed so as to be able to communication with only the RFID tag 1 which exists in the safekeeping room 100. On this account, in a relation of this time and distance, in case that a recording start position of distance information is in the gape passage judgment range and there is such a trend that a distance to the RFID tag 1 becomes larger from this start position as time advances, it is possible to judge that a user passed through the gate 80 and moved to the safekeeping room 100.

On the one hand, in case of "NO" in the step S19, the room entering/leaving monitor section 13 goes back to the step S11 and repeats from detection processing of the RFID tag 1*b*. In sum, a case of "NO" in the step S18 is conceivable as such a situation that a user, who is equipped with the RFID tag 1*b*, goes back and forth and has not yet left from a room. Then, a distance between the RFID tag 1 and the reader/writer 2 is measured continuously, and displacement of the RFID tag 1 is monitored by the room entering/leaving monitor section 13, and it goes back to the step S11 for having it judged room-entering/leaving of a user.

As above, in the monitor system 90 which relates to this embodiment, the room entering/leaving monitor section 13 of the monitor device 10 can judge room-entering/leaving of the RFID tag 1*b* in/from the safekeeping room 100, on the basis of the first history information 18 in which a distance between the RFID tag 1*b* and the reader/writer 2 was recorded in a chronological order.

Meanwhile, after the above-mentioned judgment of room-entering/leaving (S18 or S19) was terminated, detection processing of the RFID tags 1 . . . is carried out again, and distance information of the detected RFID tag 1 is calculated, and processing of the above-mentioned steps S11 through S15, for recording it in the information storage section 17 as history information is repeated.

In this manner, when room-entering/leaving of a user was judged, the above-mentioned room entering/leaving monitor section 13 notifies this judged result to the specifying section 14. Then, this specifying section 14 specifies presence or absence of article keeping by a user whom room-entering/leaving was judged, in response to the notification from the room entering/leaving monitor section 13.

Here, in the following, processing of specifying whether a user, who leaves from a room, keeps an article or not will be explained with reference to the above-mentioned FIGS. 10 and 12 through 14.

(Processing for Specifying Article Keeping of User)

Firstly, with reference to FIG. 10, in case that a user, who keeps an article, leaves from a room, respective relations of a distance between the RFID tag 1*b* which is equipped with the user and the reader/writer 2, and a distance between the RFID tag 1*a* of an article kept by the user and the reader/writer 2, will be explained.

For example, in case that a user always keeps an article at a position isolated from itself only by a predetermined distance and passes through the gate 80 and leaves from a room, a relation of an article β and the user C becomes as shown in FIG. 10.

That is, as to the RFID tag 1*a* and the RFID tag 1*b*, a distance to the reception antenna 4 of the reader/writer 2 is different, and therefore, detection timing by the reader/writer 2 for the RFID tag 1*a* and the RFID tag 1*b* becomes different. In sum, as shown in FIG. 10, the article β0 is detected in first, and after a predetermined period (between (A)-(A')) passed, the RFID tag 1*b* of the user C is detected. In addition, the user and the article leave from a room with always keeping a predetermined distance, and a graph, which shows a chronological change of a distance to the reader/writer 2, decreases with nearly the same slope, and communication with the reader/writer 2 for the article β which established communication with the reader/writer 2 in first, is stopped earlier.

On the one hand, in case that, as to an article which is gripped by a hand of a user, a distance to the reader/writer 2 becomes closer or far away than that of the user, depending on movement of for example, a hand of the user, a chronological change of a distance between both sides and the reader/writer 2 becomes a relation of a user A and an article α, or a user B and an article γ in FIG. 10.

That is, in a user and an article, a distance to the reader/writer 2 for the user becomes closer or inversely, far away, and therefore, chronological changes of the above-mentioned distances for both sides are crossed. Even in case that graphs, which show these chronological changes of the above-mentioned distances for the both sides, are different like a relation of the user A and the article α, or the user B and the article γ, a distance between the both sides at identical time is fit into a predetermined distance range.

Figure 12:
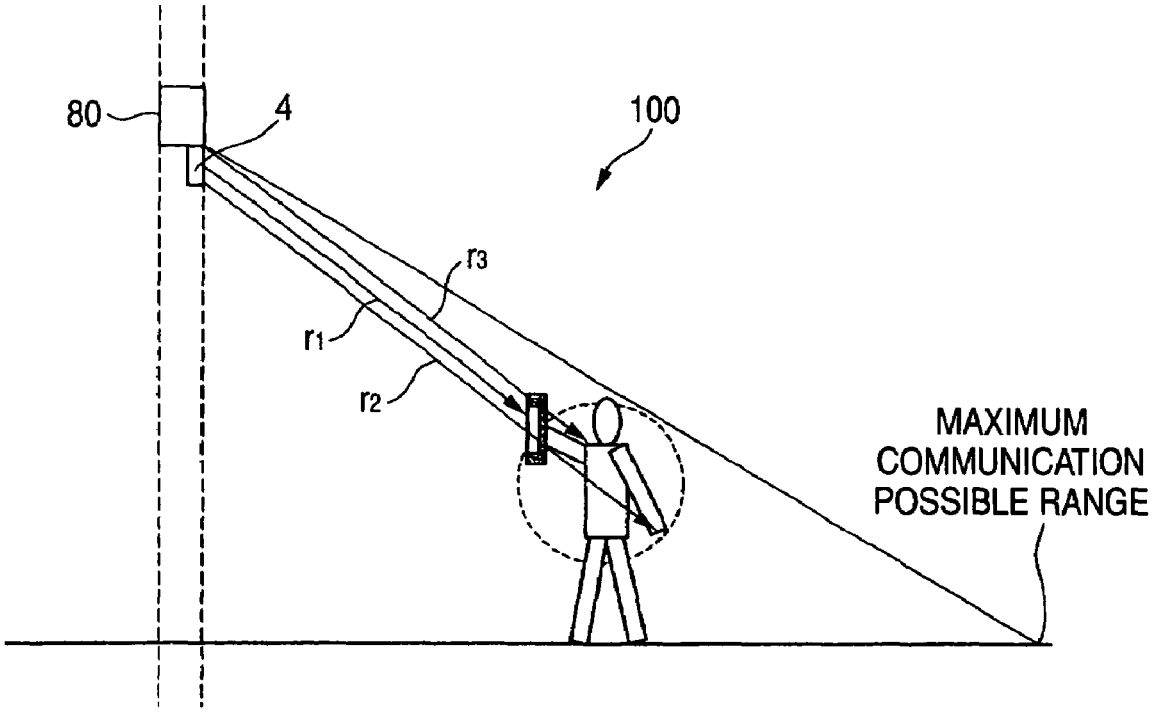
FIG. 12 is a view which schematically shows one example of a range where the reader/writer, that relates to this embodiment, can communicate, and a position relation between a user and an article.

In sum, as shown in FIG. 12, for example assuming that an article is a thing which is gripped by a hand of a user and the user is located at a predetermined position, a distance between the RFID tag 1*a* of the article which has been gripped and the reader/writer 2 becomes different, depending on a moving range of a hand of a user.

For example, in FIG. 12, when a user pokes out an article in an oblique front direction toward a room-leaving direction, a distance between the reader/writer 2 and the RFID tag 1*a* becomes the shortest (r1). On the one hand, when a user keeps an article at a position of moving it to a symmetrical position around the user itself, a distance between the reader/writer 2 and the RFID tag 1*a* becomes the longest (r2).

Therefore, assuming here that a distance between the reader/writer 2 and the RFID tag 1*b* which is equipped with a user is r3, it is possible to set a distance between a user and an article at identical time, to a value of a range including r3-r1, and r2-r3. Meanwhile, in case that an article is kept by a user, such a range of this article that it can be moved away from this user is defined here as a keeping range.

Meanwhile, this keeping range has been decided in advance, and stored in the information storage section 17. In addition, this keeping range is, in the foregoing, defined on the basis of such a range that it is possible to move an arm of a human, but it is not limited to this, and for example, it is all right even if it is set as a value of a range including a maximum communication possible range—r3. In this regard, however, the more this keeping range becomes wide, a possibility of erroneously specifying an article kept by a user as an article kept by another user becomes large, and specifying accuracy is to drop down. Then, it is desirable to set up the keeping range appropriately, in consideration of a method of carrying an article by a user, a shape of an article, a gate width of the gate 80, the number of users who utilize the safekeeping room 100, and so on.

Figure 13:
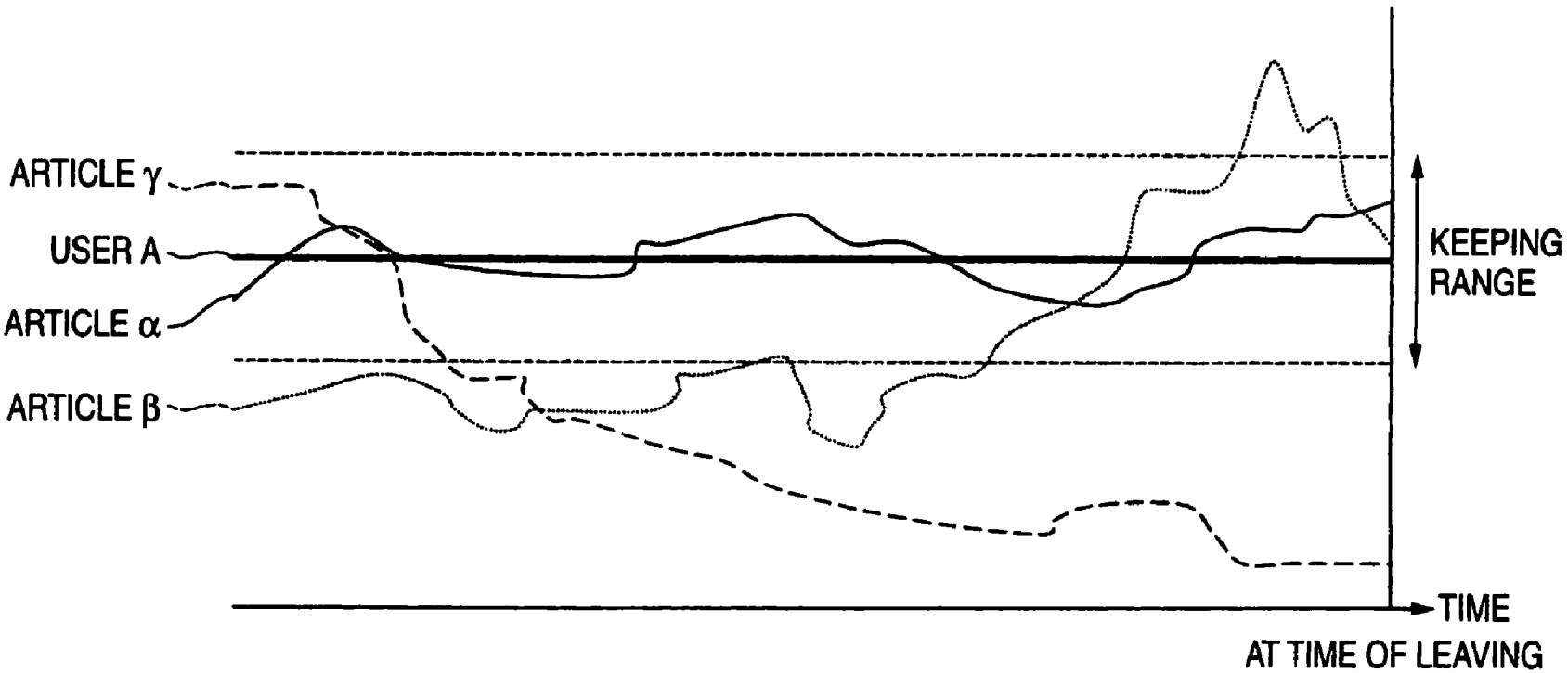
FIG. 13 is a view which shows one example of a chronological change of a distance between a user and an article on the basis of a position of the user.

Here, representing a chronological change of a distance between a user and an article on the basis of a position of the user as a graph, it becomes as shown in for example, FIG. 13.

That is, it is assumed that the articles α, β, γ are moving at the same timing as movement of the user A. In addition, it is assumed that an article, which is kept by the user A, is any one article of these articles α, β, γ and although it is not shown in FIG. 13, other users are moving with keeping remaining articles. In sum, in this FIG. 13, for the same of simplicity of explanations, it shows a chronological change of a distance to another article on the basis of movement of the user A.

Here, as described above, in this embodiment, a distance between the RFID tag 1*a* of an article kept by a user, and the RFID tag 1*b* kept by the user, is always in the above-mentioned keeping range. On this account, in the articles α through γ shown in FIG. 13, it is recognized that an article, for which a distance to the user A is always in the keeping range, is an article kept by the user A (article α). Therefore, as to a user for whom room-leaving was judged by the room entering/leaving monitor section 13, it is possible to specify an article for which a distance to the user is always in the keeping range as an article which was taken out by the user from the safekeeping room 100.

That is, the specifying section 14 specifies an article for which a distance between the user and each article at identical time always falls in a range of a keeping distance (keeping range) as an article kept by the above-mentioned user.

By doing as above, when an article, which is kept by a user who leaves from a room, is specified, the specifying section 14 notifies this specified result to the certification judgment section 15. Then, in response to this notification from the specifying section 14, the certification judgment section 15 judges whether or not a combination of specified user and article is permitted, with reference to the certification information 20. That is, hereinafter, by a processing flow shown in FIG. 14, the monitor device 10, which relates to this embodiment, carries out "Processing for Specifying Article Keeping of User" and "Advisability Judgment Processing of Taking-Out of Article by User".

Firstly, when leaving of a user is judged, the specifying section 14 judges whether or not there is an article in the keeping range regarding a user whose leaving was judged (S21). Here, in case that there is no article in the keeping range ("NO" in S21), it is judged that only a user left, and leaving of a user is permitted as it is (S26).

On the one hand, the specifying section 14, in case that it was judged that there is an article in the keeping range ("YES" in S21), judges whether or not a distance between this judged article and the above-mentioned user was in the keeping range on a steady basis (S22). Then, in case that there is such an article that a distance to the user was in the keeping range on a steady basis ("YES" in S22), this article is specified as a user's article to be taken out (S23)

On the one hand, in case that there is not such an article that a distance to the above-mentioned user falls in the keeping range on a steady basis ("NO" in S22), the specifying section 14 judged that only a user leaves, and permits leaving of the user as it is (S26). For example, as shown in FIG. 13, the article α and the article β exist in the keeping range, at the time of leaving of the user A then, in case of this FIG. 13, in the step S21, the specifying section 14 specifies that there are the article α and the article β in the keeping range. Then, as to the specified article α and article β, it is judged whether or not a distance to the user was always in a range of a keeping distance, in a recording period of distance information to the user. In FIG. 13, with regard to the article α, it is always in the keeping range, but with regard to the article β, there exists such a period that it is deviated from the keeping range. Therefore, the specifying section 14 specifies the article α as a user's article to be taken out.

As above, the specifying section 14, when it specifies an article which was take out from the safekeeping room 100 by a user who was judged to have left, notifies this specified result to the certification judgment section 15. The certification judgment section 15 judges whether or not it is permitted for the user to take out this article, with reference to the certification information 20, in a combination of the notified user and article, in response to the notification from the specifying section 14 (S24). Then, in case that the certification judgment section 15 judged that take-out of an article has been permitted (in case of "YES" in S24), it instructs the output instruction section 16 to output such a matter that room-leaving of this user is OK (S25).

The output instruction section 16 display-controls so as to display such a matter that leaving of the user with keeping the article is OK, on the display device 21, in response to this instruction from the certification judgment section 15.

Then, the user, for whom taking-out of an article was permitted, leaves from the safekeeping room 100 with keeping the article (S26).

On the one hand, in case that the certification judgment section 15 judged that taking-out of the article by the user is not permitted (in case of "NO" in S24), it instructs the output instruction section 16 so as to output taking-out disapproval of the article.

This output instruction section 16 controls so as to display such a matter that taking-out of the article by the user is not permitted, on the display device 21, in response to the instruction from the certification judgment section 15 (S27). In addition, the output instruction section 16 the output instruction section 16 instructs, in this display device 21, so as to display a name of the article for which taking-out is not permitted, and so as for the use to return the article to an original storage position (S28). Then, return of the article by the user is completed, and then, leaving of the user is permitted (S26).

As above, in the monitor system 90 which relates to this embodiment, the specifying section 14 judges presence or absence of an article which is in the keeping range, at the time of leaving of a user, and thereby, can judge whether or not there is an article which is taken out by the user. Especially, the specifying section 14 can specify an article for which a distance to the user was present in the keeping range on a steady basis, as an article which enters/leaves in/from the safekeeping room 100 together with a user, with reference to the first history information 18 and the second history information 19, among articles which were judged to be in the keeping range at the time of leaving.

On this account, in the monitor system 90 which relates to this embodiment, it is possible to specify a combination of a user and an article which enter/leave in/from the safekeeping room 100 concurrently, with high precision.

In addition, as described above, in the above-mentioned monitor system 90, it was of such a configuration that it is possible to specify a combination of a user and an article which enter/leave in/from the safekeeping room 100 concurrently, by judging presence or absence of an article which exists in the keeping range of a user on a steady basis.

On this account, even in case that a plurality of users keeping articles enter/leave in/from the safekeeping room 100, it is possible to specify a combination of a user and an article which enter/leave in/from the safekeeping room 100. For example, as shown in FIG. 15, it is assumed that a user X1 and a user X2 leave from the safekeeping room 100 nearly simultaneously.

Figure 15:
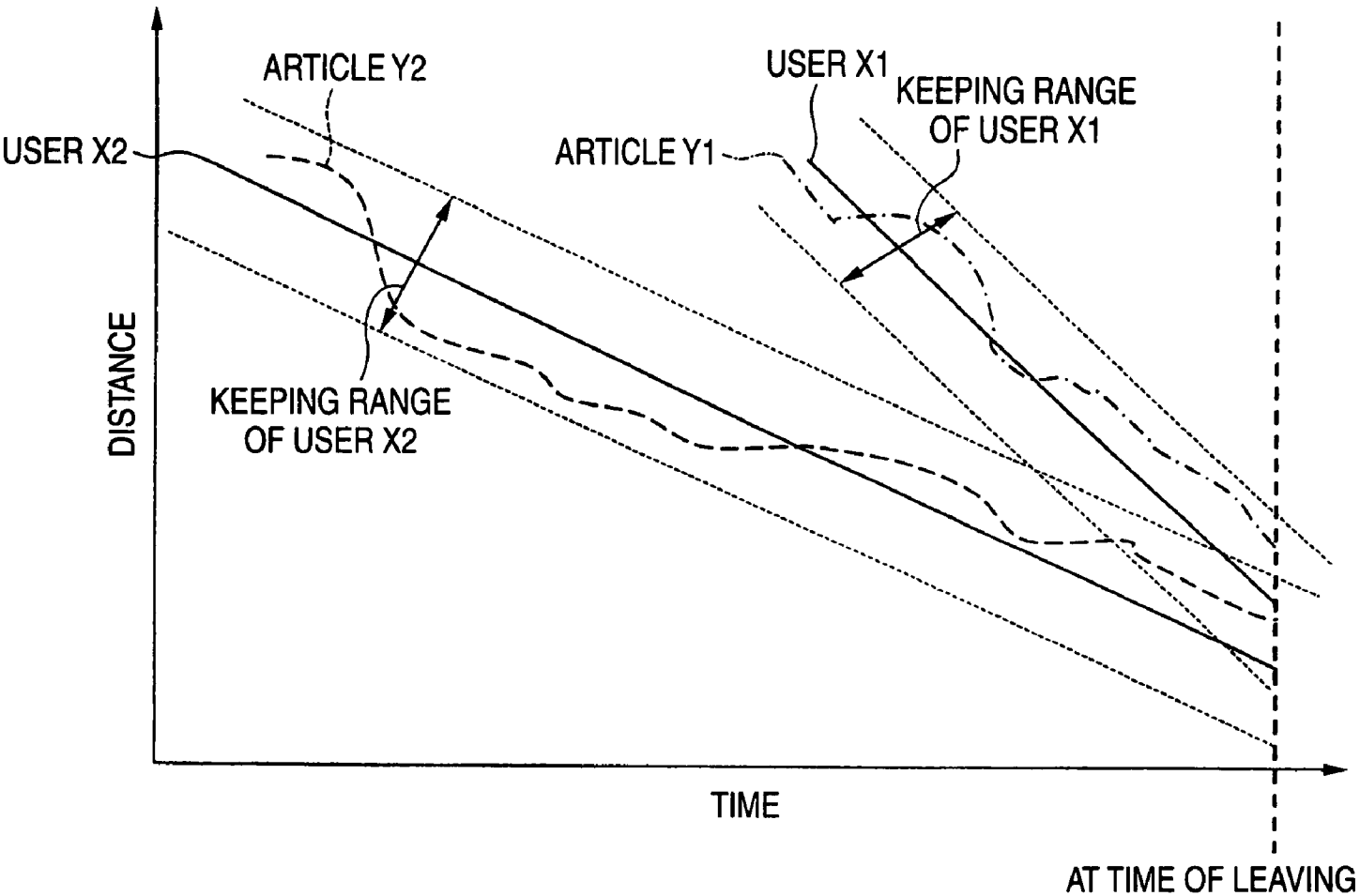
FIG. 15 is a view which shows one example of a chronological change of respective distances of plural users, and distances of articles kept by the respective users.

Meanwhile, this FIG. 15 is a view which shows one example of a chronological change of respective distances to the plurality of users, and distances of articles kept by respective users, and it is assumed that each user is moving toward the gate 80 at a constant speed.

In this case, looking at only a leaving time point, for example, an article Y1 and an article Y2 are included in a keeping range of the user X1, and it is not possible to specify an article which left from the safekeeping room 100 together with the user X1.

However, in this embodiment, the first history information 18 and the second history information 19 have been stored in the information storage section 17, and therefore, it is possible to know a position relation of a user and an article in a chronological order. Then, as shown in FIG. 15, an article, which always exists in the keeping range of the user X1, is the article Y1, and an article, which always exists in a keeping range of the user X1, is the article Y2, and therefore, it is possible to specify that a combination of entering/leaving in/from the safekeeping room 100 concurrently is the user X1 and the article Y1, or the user X1 and the article Y2.

Meanwhile, FIG. 15 shows such an example that two users leave simultaneously, but even in case that one enters in a room and the other leaves from the room, it is possible to specify a combination of a user and an article which enter in a room, or a combination of a user and an article which leave from a room, with reference to the firs history information 18 . . . and the second history information 19 . . . In addition, the number of users, who enter/leave simultaneously, is not limited to this two persons.

Therefore, there is no need to restrict a gate width of the above-mentioned gate 80, for example, in such a manner that a user enters and leaves one by one, and it is possible to design it freely, depending on a range of the transmission antenna 3 and the reception antenna 4, which the reader/writer 2 is equipped with, can communicate.

In addition, in the monitor system 90 which relates to this embodiment, the monitor device 10 is equipped with the certification judgment section 15. On this account, for example in case that taking-out of an article from the safekeeping room 10 is carried out by a user, it is possible to judge whether or not taking-out of this article is permitted to the user.

Therefore, in the monitor system 90 which relates to this embodiment, it is possible to restrict taking-out of an article by a user, depending on information of an article that can be taken out, which has been allocated with respect to each user.

Meanwhile, in the monitor system 90 which relates to this embodiment, as described above, it was configured in such a manner that histories of distance information of users . . . are stored as the first history information 18 . . . , and histories of distance information of articles . . . are stored as the second history information 19 . . . , in the information storage section 17, and on the basis of the first history information 18, leaving of a user is judged by the room entering/leaving monitor section 13, and on the basis of the first history information 18 and the second history information 19, the specification section 14 specifies an article kept by a user who was judged by the room entering/leaving monitor section 13 to enter/leave in/from the safekeeping room 100.

Here, in the monitor system 90 which relates to this embodiment, it is all right even if it is configured in such a manner that an article of the RFID tag 1*a*, which was present in a keeping range of the RFID tag 1*b*, is specified as a thing which was kept by a user, at such a time point that return of a response signal from the RFID tag 1*b* was stopped, without recording the above-mentioned first history information 18 and the second history information 19.

In case of configuring in this manner, the above-mentioned monitor device 10 has no need to record respective distance information of the RFID tag 1*a* and the RFID tag 1*b*, in a chronological order, as the first history information 18 . . . and the second history information 19 . . . , in the information storage section 17. On this account, it is possible to reduce an amount of data to be stored in the information storage section 17.

However, in the above-mentioned configuration in which the first history information 18 . . . and the second history information 19 . . . are not stored in the information storage section 17, it is judged that, on the occasion that leaving of a user was judged, all articles, which are present in a keeping range of the user, are judged as an article which was taken out by this user. On this account, for example as shown in the above-mentioned FIG. 13 or 16, in case that a plurality of articles exist in a keeping range of a user, it is not possible to specify an article which was taken out by the user, with high precision.

On this account, in order to specify an article which was taken out by a user, with high precision, it is desirable to configure to store the first history information 18 . . . and the second history information 19 . . . in the information storage section 17, as described in the above-described this embodiment.

In addition, in the above-mentioned embodiment 1, it was of a configuration for specifying a user who leaves from a room and an article which is taken out by the user, by utilizing distance information between the reader/writer 2 and the RFID tag 1. However, it is also possible to make a configuration for specifying a user who leaves from a room and an article which is taken out by the user, by showing whereabout positions of a user and an article at two-dimensional coordinate positions in the safekeeping room 100, but not a distance, and monitoring its displacement in a chronological order. Hereinafter, as an embodiment 2, a monitor system 90 relating to another embodiment of the present invention will be explained. Meanwhile, in this embodiment 2, the same reference numerals and signal are attached to the same members as those shown in the embodiment 1, and their explanations will be omitted.

Embodiment 2

In the monitor system 90 which relates to this embodiment, at least one or more articles are stored in the safekeeping room 100, in the same manner as in the above-mentioned embodiment 1, and each article is equipped with a RFID tag 1*a*. In addition, each of users, who enter in this safekeeping room 100 and utilize the above-mentioned article, is to possess a room-entering permit including a RFID tag 1*b*. Then, in this safekeeping room 100, a gate 90 is disposed at a gateway to an outside.

At least one or more reader/writers 2 are provided in the above-mentioned safekeeping room 100, and the reader/writer 2 is connected to a monitor device 10.

Figure 16:
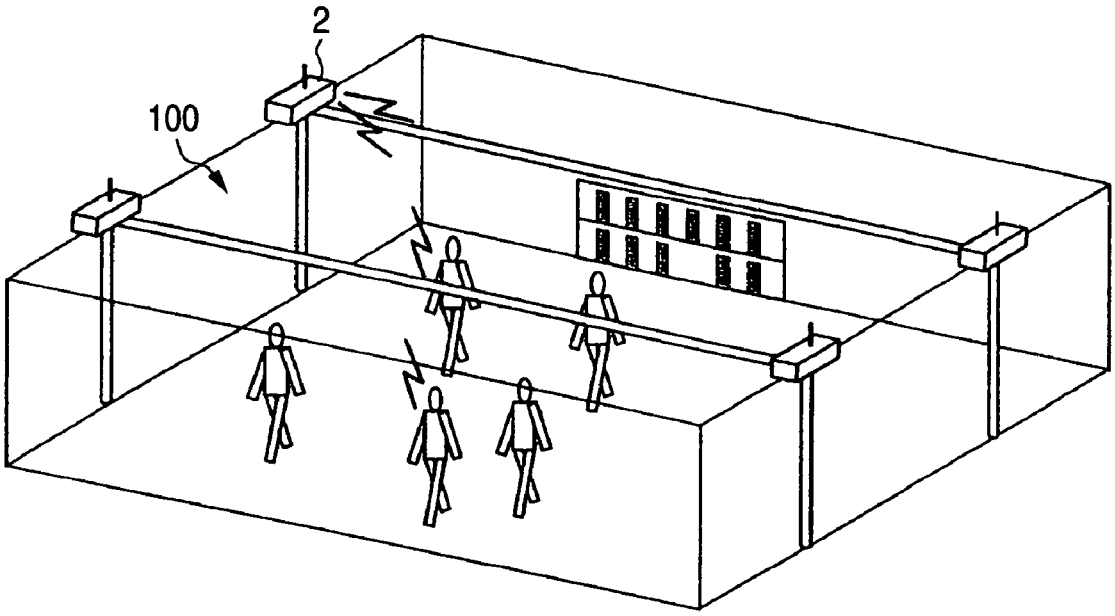
FIG. 16 is a view which shows an example in case that the monitor system, that relates to this embodiment, was applied, assuming that an entire inside of a safe keeping room is set as a communication possible range.

Meanwhile, the reader/writer 2, which is provided in this safekeeping room 100, is one unit in the above-mentioned FIG. 2, but as shown in FIG. 16, it is all right eve if it is configured so as to enable a user to enter/leave, by setting up the entire safekeeping room 100 as a communication area, without disposing the gate. In case of configuring in this manner, as to the number of the reader/writers 2, a plurality of them are to be disposed, depending on a width of an inside of the safekeeping room 100.

Figure 17:
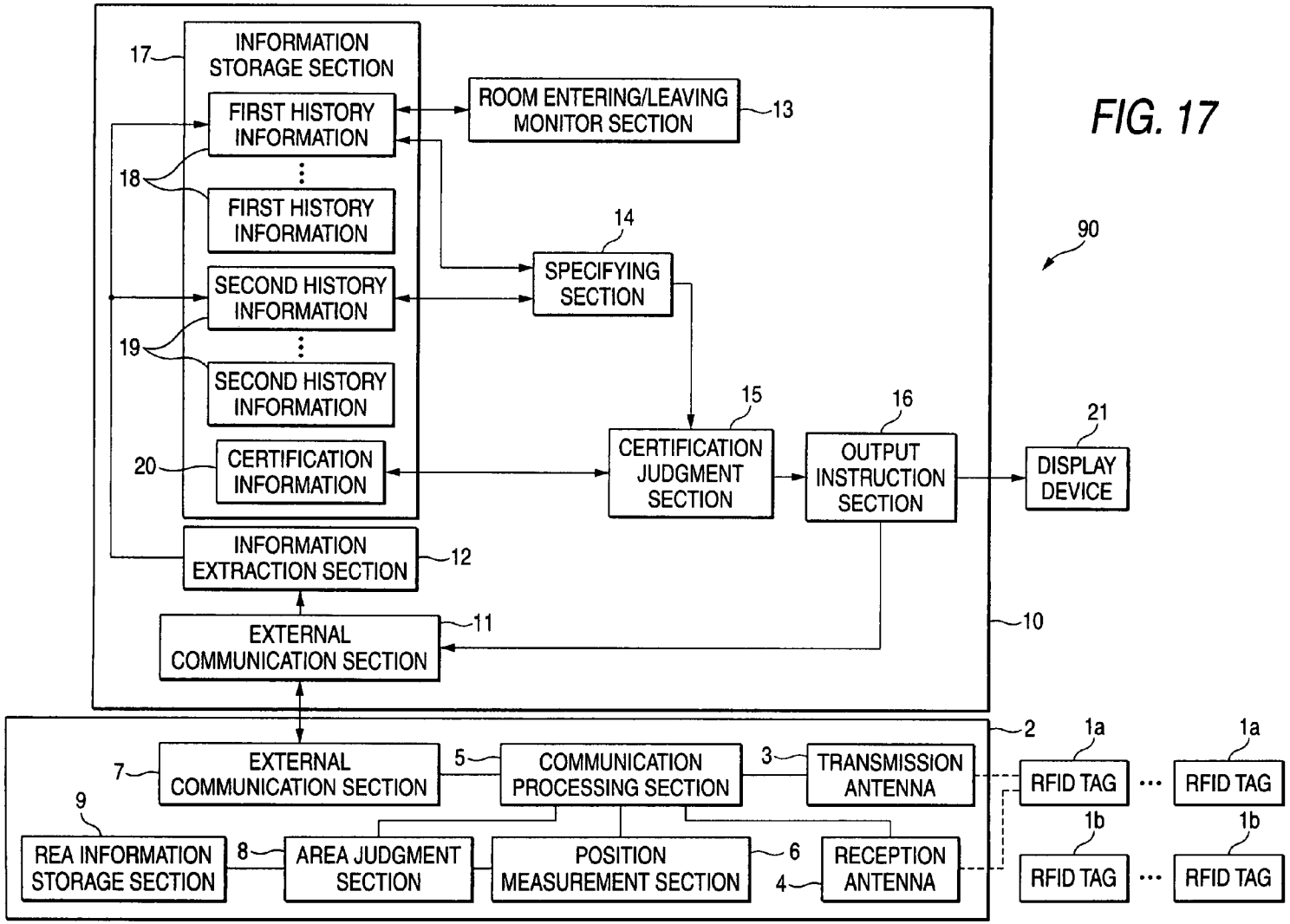
FIG. 17 is a thing which shows another exemplary, non-limiting embodiment of the present invention, and is a block diagram which shows a substantial part configuration of a monitor system.

Here, with reference to FIG. 17, a substantial part configuration of the monitor system 90 relating to this embodiment will be explained. As shown in FIG. 17, in the monitor system 90 which relates to this embodiment, as compared to the monitor system 90 shown in the embodiment 1, it is different on such a point that the reader/writer 2 further has an area judgment section 8 and an area information storage section 9.

In addition, the position measurement section 6 shown in the embodiment 1 was a configuration for calculating only distance information of the RFID tag 1 which has been detected, but a position measurement section 6, which relates to this embodiment, is different on such a point that it calculates existence position direction information of the RFID tag 1 in addition to the distance information. Meanwhile, details of a method for calculating this existence position direction information will be described later.

In sum, the above-mentioned area judgment section 8 is a block which specifies which position the RFID tag exists at in a communication area in the safekeeping room 100, on the basis of the distance information and the existence position direction information of the RFID tag 1, which were measured in the position measurement section 6.

Figure 20:
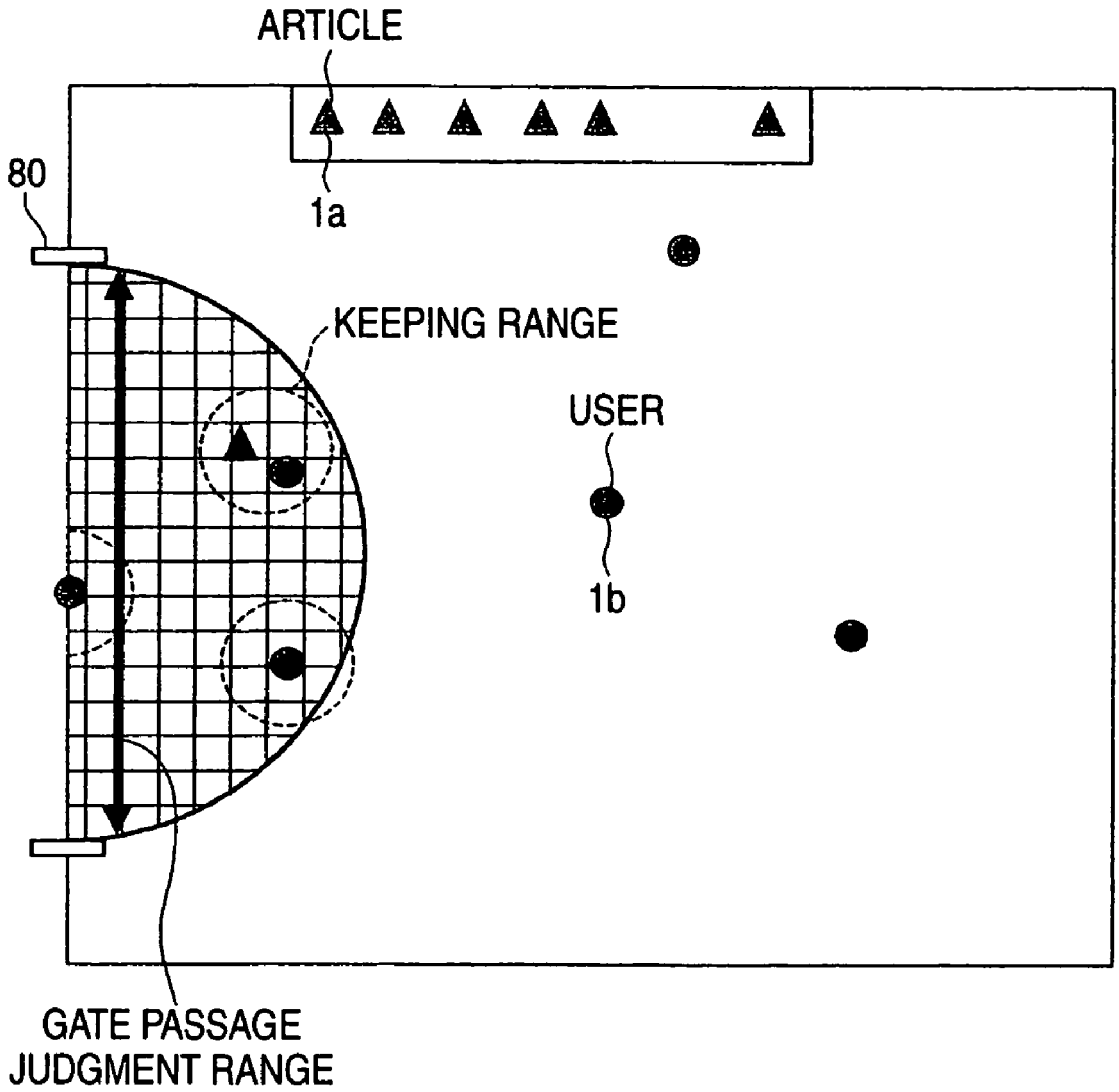
FIG. 20 is a view which schematically shows one example of area information.

That is, area information for defining a region of a communication area in the safekeeping room 100 has been stored in the area information storage section 9. This area information is, concretely speaking, information which shows a two-dimensional region of the communication area which is a region where the reader/writer 2 can communicate, as shown in FIG. 20, and it is configured so as to be able to specify a position in the area region by two-dimensional coordinates. Meanwhile, this FIG. 20 is a thing which schematically shows one example of the area information, and the area information is not limited to this. For example, in the above-mentioned area information, coordinate axes were setup to a region which corresponds to the communication area, but it is all right even if these coordinate axes are set up to the entire safekeeping room 100. In addition, in this embodiment, position information, which specifies the RFID tag 1 in the communication area, is represented by two-dimensional coordinates, but it is all right even if it is configured so as to represent position information of the RFID tag by three-dimensional coordinates. Meanwhile, a circle shown in this FIG. 20 indicates the RFID tag 1*b* kept by a user, and Δ indicates the RFID tag 1*a* which was equipped with an article.

Meanwhile, in case of showing position information of the RFID tag 1 by three-dimensional coordinates, it can be realized by providing three sets of a set of the transmission antenna 3 and the reception antenna 4 in the reader/writer 2 which relates to this embodiment, and by calculating an existence position direction of the RFID tag 1 in a height direction of the safekeeping room 100, and an existence position direction of the RFID tag 1 in a horizontal direction of the safekeeping room 100.

Then, the area judgment section 8 specifies where the RFID tag 1 exists anywhere in a communication area defined by the above-mentioned area information, on the basis of information measured in the position measurement section 6, and converts it into position information represented by two-dimensional coordinates.

Meanwhile, in this embodiment, it is of such a configuration that the detected position of the RFID tag 1 is converted into two-dimensional coordinate information in the communication area, by the area judgment section 8, but it is not limited to this.

For example, it is all right even if it is configured in such a manner that the above-mentioned area judgment section 8 converts the detected position of the RFID tag 1 into information of three-dimensional coordinates, on the basis of position information acquired from the reader/writer 2 which is equipped with three or more sets of the set of the transmission antenna 3 and the reception antenna 4.

Meanwhile, the area information, which has been stored in the area information storage section 9, is to be set up depending on an environment where the reader/writer 2 is disposed. It is all right even if it is configured in such a manner that the setting of this area information is carried out from the monitor device 10, for example through the external communication section 7, and it is all right even if the reader/writer 2 is equipped with a user interface for inputting the area information.

Information of two-dimensional coordinates of the RFID tag 1, which was specified by the above-mentioned area judgment section 8, is transmitted from the communication processing section 5 to the monitor device 10 through the external communication section 7, as position information.

In addition, in the monitor device 1—shown in the above-described embodiment 1, the first history information 18 and the second history information 19, which are stored in the information storage section 17, were distance information between the reader/writer 2 and the RFID tag 1. In contrast to this, in this embodiment, it is different on such a point that the first history information 18 and the second history information 19 are position information expressed by two-dimensional coordinates, in a communication area in the safekeeping room 100 viewed from the reader/writer 2/

In addition, in the above-described embodiment 1, it was of such a configuration that the room entering/leaving monitor section 13 judges of user's entering/leaving in/from the safekeeping room 100 on the basis of the first history information 18 which is a history of distance information of the RFID tag 1*b*. In contrast to this, the room entering/leaving monitor section 13, which relates to this embodiment, is different on such a point that user's entering/leaving in/from the safekeeping room 100 is judged on the basis of the first history information 18 which is a history of position information in which a position of the RFID tag 1*b* was shown by two-dimensional coordinates.

In addition, in the above-described embodiment 1, it was of such a configuration that the specifying section 14 specifies whether or not a user, who was judged to have left from a room, took out an article, on the basis of the first history information which is a history of distance information of the RFID tag 1*b*, and the second history information 19 which is a history of distance information of the RFID tag 1*a*. However, in this embodiment, it is different on such a point that it is configured in such a manner that the specifying section specifies whether or not a user, who was judged to have left from a room, took out an article, on the basis of the first history information which is a history of the above-mentioned position information of the RFID tag 1*b*, and the second history information 19 which is a history of the above-mentioned position information of the RFID tag 1*a*. Other configurations are the same as the configurations shown in FIG. 1, and therefore, their explanations will be omitted here.

(Position Prediction Processing)

In the above-described embodiment 1, to measure a distance of each RFID tag 1 was explained, but in the monitor system 90 which relates to this embodiment, it is configured so as to further measure an existence position direction of each RFID tag 1 on the occasion of taking a look at it from the reader/writer 2. That is, as described above, in this embodiment, it is possible to specify an existence position of each RFID tag 1, by specifying a distance and a direction to each RFID tag 1.

As this method of estimating an existence position direction of the RFID tag 1, in the monitor system 90 which relates to this embodiment, a plurality of antenna elements of the reception antennas 4 are lined up in the shape of an array, and a phase difference of signals received by each antenna element is detected. Hereinafter, prediction processing of this existence position direction of the RFID tag 1 will be explained.

Figure 18:
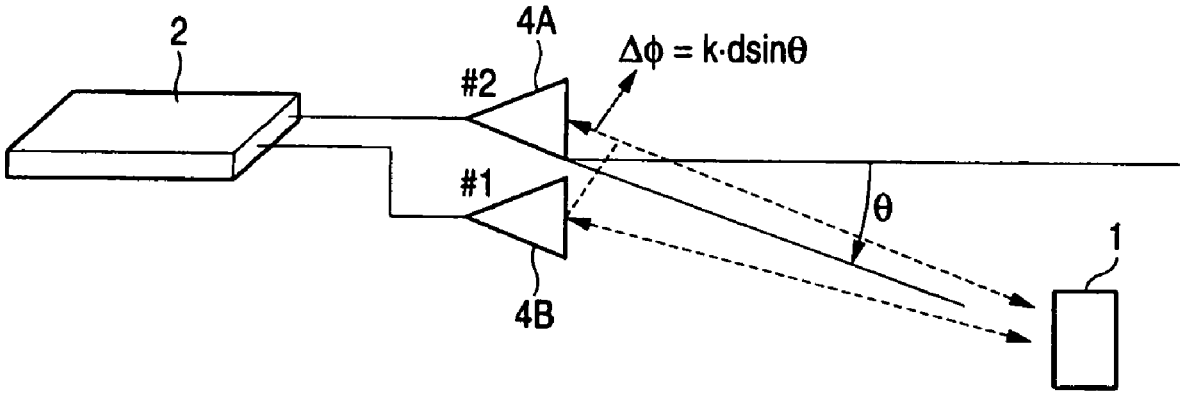
FIG. 18 is a view which schematically shows prediction processing of an existence position direction of a RFID tag.

FIG. 18 is a view which schematically shows prediction processing of an existence position direction of the RFID tag 1. In the same figure, the reception antenna 4 is configured by two antenna elements of a first antenna element 4A and a second antenna element 4B. In addition, θ designates an angle which shows an existence position direction of the RFID tag 1. This θ has become an angle in case that a normal line direction of a plane including both of electromagnetic wave reception points at the first antenna element 4A and the second antenna element 4B was set to 0°.

Assuming that a distance between electromagnetic wave reception points at the first antenna element 4A and the second antenna element 4B is d, a phase difference Δφ of signals received by the first antenna element 4A and the second antenna element 4B is represented by the following formula.

$$\Delta\phi = k \cdot d\sin\theta \qquad \text{[Mathematical Formula 10]}$$

$$\because k = \frac{2\pi}{\lambda}$$

Here, assuming d=λ/2, the phase difference Δφ is represented by the following formula.

$$\Delta\phi = \pi \sin\theta \qquad \text{[Mathematical Formula 11]}$$

Thus, on the basis of a phase difference Δφ, an existence position direction θ is represented by the following formula.

$$\theta = \sin^{-1}\frac{\Delta\phi}{\pi} \qquad \text{[Mathematical Formula 12]}$$

That is, it is possible to obtain the existence position direction θ by obtaining the phase difference Δφ.

Figure 19:
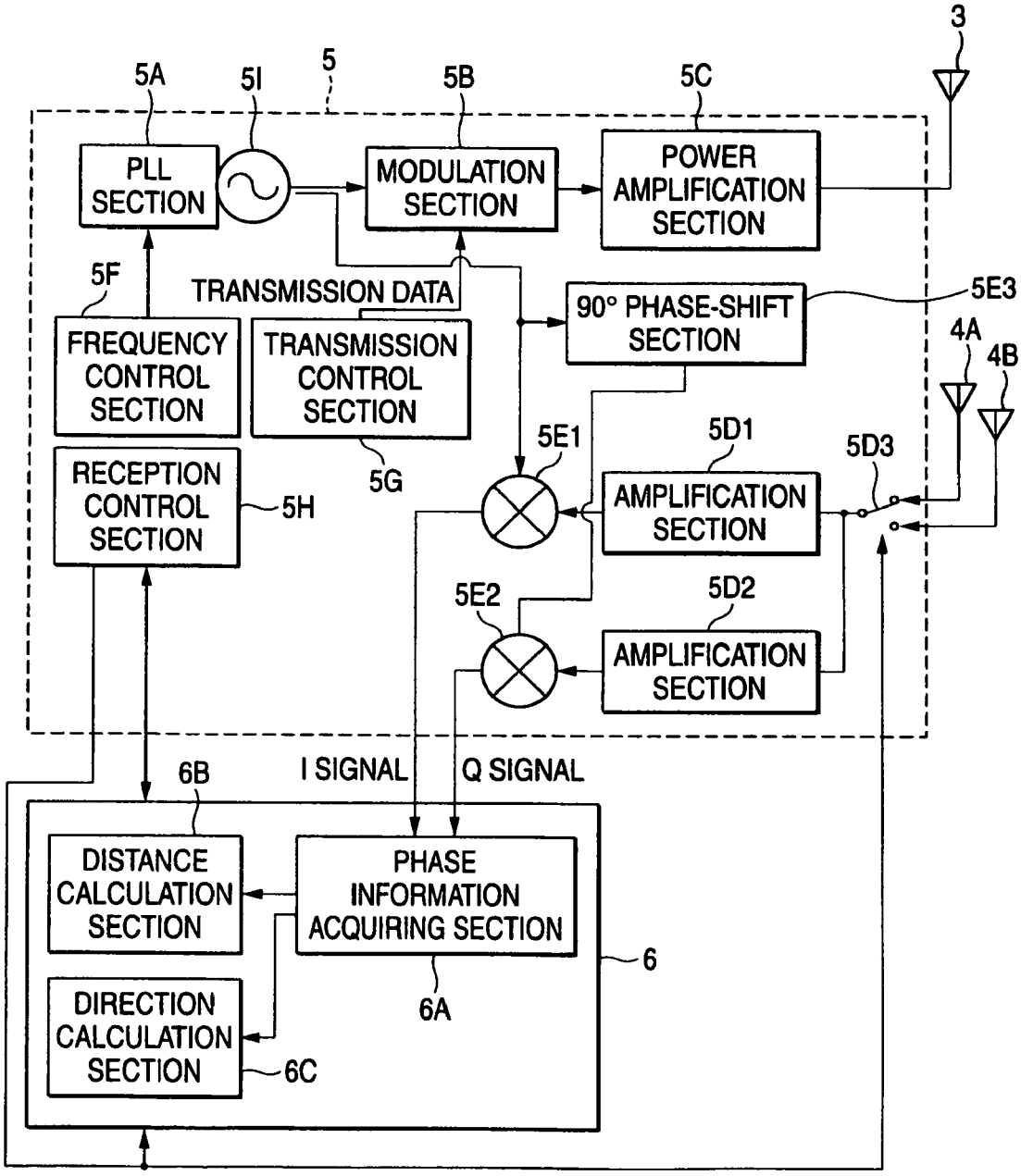
FIG. 19 is a view which shows a configuration of a reader/writer in case of carrying out direction calculation.

FIG. 19 shows a configuration of the reader/writer 2 in case of carrying out direction calculation. A configuration shown in the same figure is different on such points that a direction calculation section 6C is disposed in the position measurement section 6, in the above-mentioned configuration shown in FIG. 5, and a selector 5D3 is disposed in the communication processing section 5. Other configurations are the same as the configurations shown in FIG. 5, and therefore, their explanations will be omitted here.

The selector 5D3 selectively switches over a signal received by the first antenna element 4A in the reception antenna 4, and a signal received by the second antenna element 4B, and transfers it to the amplification section 5D1 and the amplification section 5D2. Selection control of this selector 5D3 is carried out by the reception control section 5H.

The direction calculation section 6C acquires information as to a phase difference between the signal received by the first antenna element 4A and the signal received by the second antenna element 4B, from the position information acquiring section 6A, and calculates the existence position direction θ of the RFID tag 1 on the basis of this, by the above-mentioned processing. Then, the reception control section 5H acquires distance information calculated by the distance calculation section 6B, and existence position direction information calculated by the direction calculation section 6C, and transfers this information to the area judgment section 8.

The area judgment section 8 specifies which position in the communication area in the safekeeping room 100, the RFID tag 1 exists at, on the basis of the above-mentioned distance information and as position information and the existence position direction information. On this occasion, the area judgment section 8 specifies which position in the communication area in the safekeeping room 100, the RFID tag 1 exists at, on the basis of the area information which has been stored in the area information storage section 9, and calculates two-dimensional coordinate information. That is, as shown in FIG. 20, the area judgment section 8 specifies the above calculated distance information and existence position direction information to the RFID tag 1, as points on a two-dimensional coordinate.

Meanwhile, as a method of obtaining the existence position direction θ of the RFID tag 1, it is not limited to the above-mentioned method, and it is possible to use publicly known various methods. For example, as technology of estimating an electromagnetic wave incoming direction (DOS (Direction Of Arrival), Beam former method, Capon method, LP (Linear Prediction) method, Min-Norm method, MUSIC method, and ESPRIT method etc. are cited.

(Flow of Position Prediction Processing)

Figure 21:
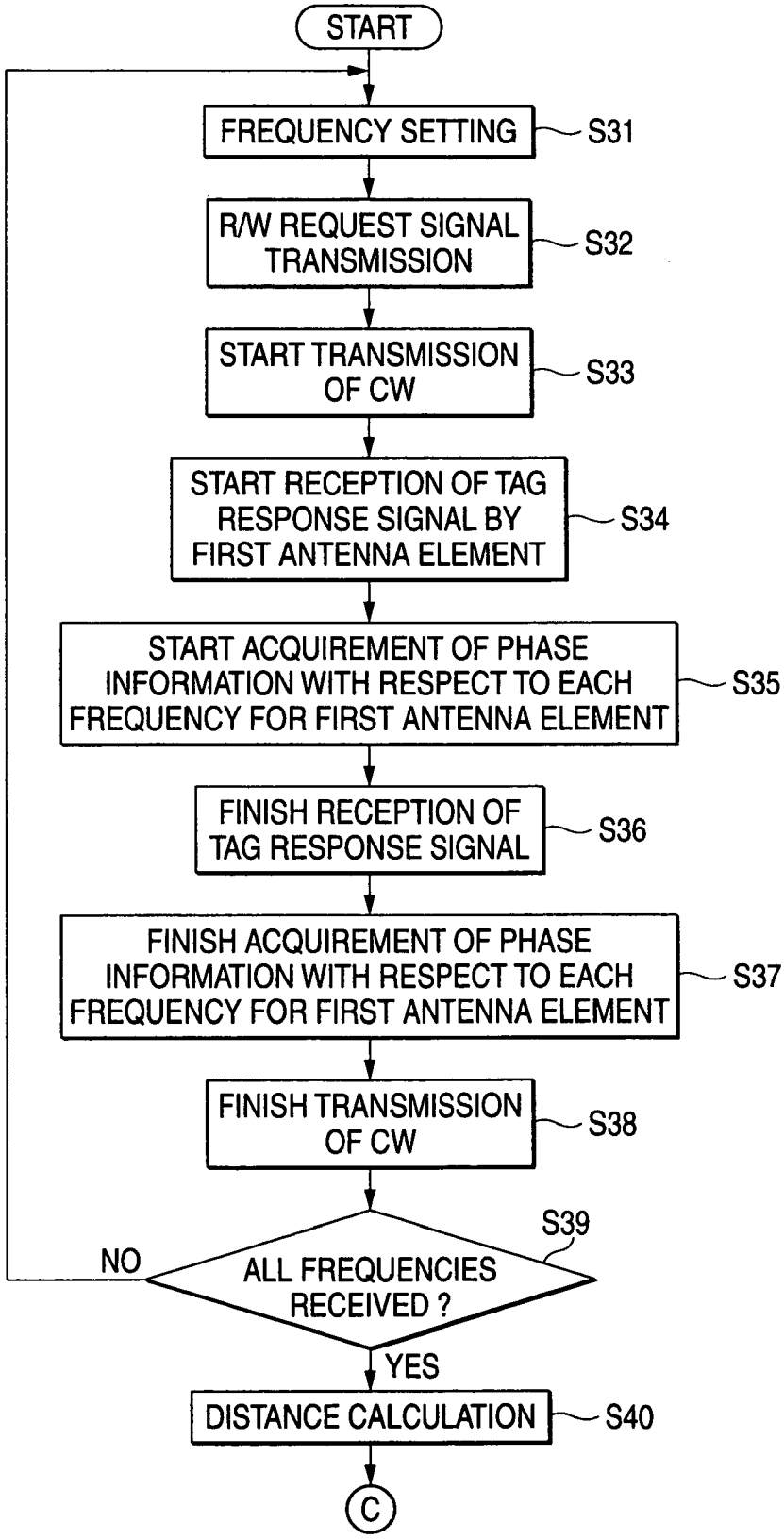
FIG. 21 is a flow chart which shows an anterior half of a flow of position prediction processing.
Figure 22:
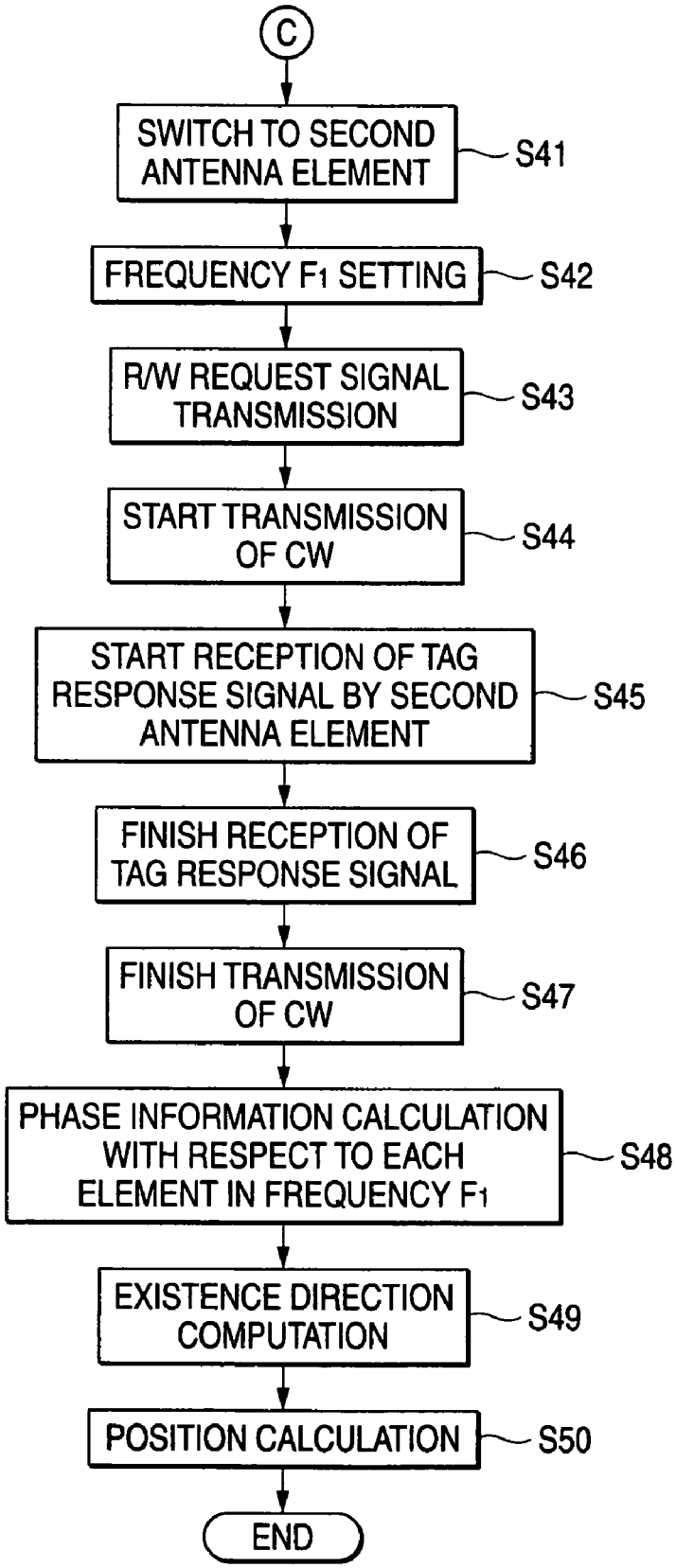
FIG. 22 is a flow chart which shows a posterior half of the flow of the position prediction processing.

Next, a flow of the above-described position prediction processing in the reader/writer 2 will be explained, over referring to flow charts shown in FIGS. 21 and 22.

Firstly, when the position prediction processing is started, the frequency control section 5F controls the PLL section 5A in such a manner that frequency of carrier signals on the occasion of transmitting the R/W request signal becomes first frequency, in a step S31.

Next, the transmission control section 5G controls the modulation section 5B so as to have data showing the R/W request signal, overlapped with carrier signals. Then, transmission signals, which were modulated by the modulation section 5B, are outputted from the transmission antenna 3 after they are amplified by the power amplification section 5C (S32).

Then, the CW (continuous carrier wave) which follows the R/W request signal is transmitted by the first frequency f1 (S33).

When the RFID tag 1 detects the R/W request signal, the RFID tag 1 transmits the tag response signal by the carrier frequency corresponding to the first frequency f1 of CW (continuous carrier wave) detected after the R/W request signal. The reception antenna 4 receives this tag response signal. At this point, the selector 6D selects the first antenna element 4A, and thus, the communication processing section 5 carries out the reception processing (S34) based on the signal received by the first antenna element 4A, and then the phase information acquiring section 6A carries out the phase information acquiring processing (S35).

More specifically, in the communication processing section 5, the frequency conversion section 5El calculate I signals and Q signals by mixing the reception signal inputted from the amplification section 5D1 and the carrier signal outputted by the PLL section 5A based on the above-mentioned mathematical formulas 4 to 6. The phase information acquiring section 6A receives the I signals and Q signals from the frequency conversion section 5El, then calculates the phase change amount $\phi$1 and $\phi$2 based on the mathematical formulas 7 to 8, and forms and stores a table listing the phase change amount $\phi$1 and $\phi$2 associated with the frequency used as the carrier signal (the first frequency f1).

After the reception of the tag response signal from the RFID tag 1 is completed in the communication processing section 5 (S36), the phase information acquiring section 6A finishes the phase information acquiring processing (S37). After that, the communication processing section 5 finishes the transmission of CW (continuous carrier wave), that is, the transmission of the signal of one frame (S38). After that, the reception control section 5H judges whether or not it received reception signals of all frequencies to be received, and in case that it was judged that it has not received all (NO in S39), it goes back to processing from S31. It is judged that it received reception signals of all frequencies to be received (YES in S39), and it is moved to processing of S40 to carry out the distance calculation in the distance calculation section 6B. Meanwhile, the position measurement section 6 carries out not only calculation of a distance on the basis of the phase information, but may calculate a distance by for example, a method to which the MUSIC method was applied.

In the step S41, the selector 5D3 is switched over so as to select the second antenna element 4B. Then, based on the control by the transmission control section 5G, the R/W request signal and the CW (continuous carrier wave) which follows the R/W request signal are transmitted by the first frequency f1 (S42 to S44).

When the RFID tag 1 detects the R/W request signal, the RFID tag 1 transmits the tag response signal by the carrier frequency corresponding to the first frequency f1 of the CW (continuous carrier wave) detected after the R/W request signal. The reception antenna 4 receives this tag response signal. At this point, the selector 6D selects the second antenna element 4B, and the communication processing section 5 carries out the reception processing (S45) based on the signal received by the second antenna element 4B.

More specifically, in the communication processing section 5, the frequency conversion section 5E2 calculated I signals and Q signals by mixing the reception signal inputted from the amplification section 5D2 and the carrier signal outputted by the PLL section 5A based on the above-mentioned mathematical formulas 4 to 6. After the reception of the tag response signal from the RFID tag 1 is completed in the communication processing section 5 (S46), the communication processing section 5 finishes the transmission of CW (continuous carrier wave), that is, the transmission of the signal composed from one frame (S47).

In S48, the phase information acquiring section 6A detects a phase difference between signals received by the first antenna element 4A, and signals received by the second antenna element 4B, and on the basis of this, the direction calculation section 6C calculates an existence position direction (existence direction) of the RFID tag 1 (S49). Meanwhile, on the occasion of carrying out direction prediction on the basis of a phase difference between antenna elements as described above, it is necessary to compare phase differences at certain (identical) frequency.

After that, the reception control section 5H acquires the distance information calculated by the distance calculation section 6B, and the existence position direction information calculated by the direction calculation section 6C, and transfers this information to the area judgment section 8. The area judgment section 8 calculates a position of the RFID tag 1, on the basis of the above-mentioned distance information and existence position direction information (S50). By the foregoing, position measurement processing is completed.

(Processing for Specifying Article Keeping of User)

Subsequently, processing for specifying article keeping at the time of room-leaving of a user will be explained.

In the monitor system 90 which relates to this embodiment, it is of such a configuration that it is possible to specify a two-dimensional coordinate position of the RFID tag 1, in a communication area, as position information. Then, it is of such a configuration that a history of position information of the RFID tag 1*a* is stored as the second history information 19, and also, a history of position information of the RFID tag 1*b* is stored as the first history information 18, in the information storage section 17.

On this account, the room entering/leaving monitor section 13 can judge, with reference to the first history information 18, that a user left from a room, in case that displacement of the RFID tag 1*b* since the time that it is detected in a communication area, becomes as follow. That is, in case that the RFID tag 1*b*, which has been detected, comes close to the gate 80 and passes through a gate passage judgment range in the gate 80 and position information of the above-mentioned RFID tag 1*b* is stopped, it is possible to judge that a user, who is equipped with the RFID tag 1*b*, left a room.

Inversely, in case that the RFID tag 1*b*, which was detected, passes through the above-mentioned gate passage judgment range and is moving in a direction away from the gate 80, it is possible to judge that a user, who is equipped with the RFID tag 1*b*, entered in the room.

By doing as above, when the above-mentioned room entering/leaving monitor section 13 judges room-entering/leaving of a user, it notifies that matter to the specifying section 14. The above-mentioned specifying section 14, when it receives this notification, judges whether or not the RFID 1*a* of an article exists, in a keeping range of the RFID tag 1*b* of a user for who room-entering/leaving was judged. This keeping range is, as defined in the embodiment 1, a range which can be departed from a user, in case that an article is kept by this user. In this embodiment, a two-dimensional coordinate range of a predetermined range from a two-dimensional coordinate position of the detected RFID tag 1*b* is defined as this keeping range.

Figure 14:
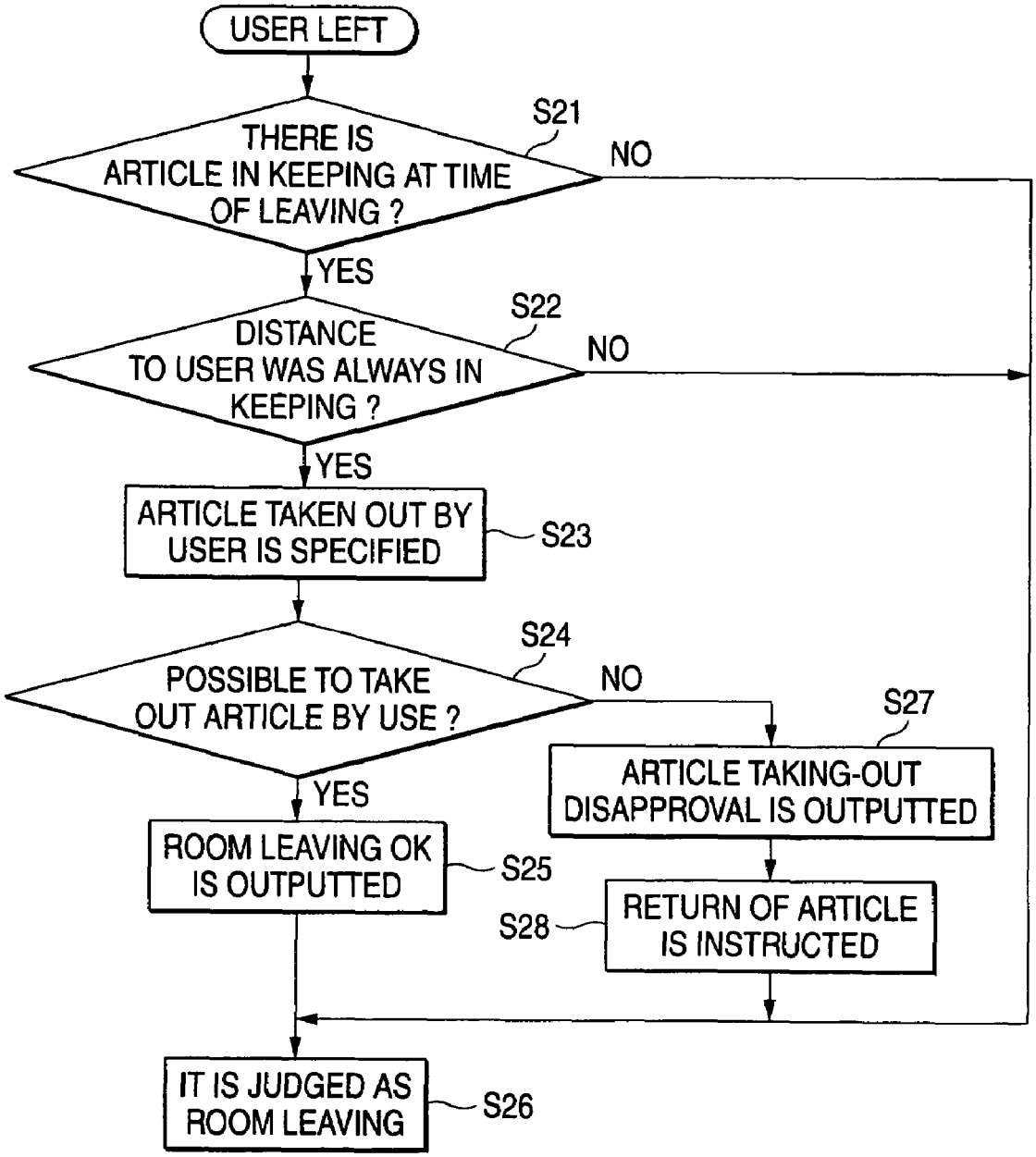
FIG. 14 is a flow chart which shows processing for specifying article keeping of a user, and article taking-out advisability judgment processing by a user, in the monitor system that relates to this embodiment.

Details of processing subsequent to this are basically the same as "Processing for Specifying Article Keeping of User" (S22 through s26) in the embodiment 1 shown in FIG. 14. That is, when leaving of a user is judged, the specifying section 14 judges whether or not there is the RFID tag 1*a* of an article in the keeping range of the RFID tag 1*b* of a user who was judged to have left. Here, in case that there is no RFID tag 1*a* of an article in the keeping range, it is judged that only a user left a room, and leaving of the user is permitted as it is.

On the one hand, the specifying section 14, in case that it was judged that there is the RFID tag 1*a* of an article in the keeping range, judges whether or not position coordinates of the RFID tag la of this judged article and the RFID tag 1*b* of the above-mentioned user exist in the keeping range on a steady basis. Then, in case that there was the RFID tag 1*a* of an article for which a position coordinate exists in the keeping range of the RFID tag 1*a* of the above-mentioned user, on a steady basis, this article is specified as an article taken out by the user.

On the one hand, in case that a position coordinate of the RFID tag 1*a* of the above-mentioned article does not exist in the keeping range on a steady basis, the specifying section 14 judges that only the user is leaving, and permits leaving of the user as it is.

That is, even if there exists an article which is present in the keeping range of the user at the time of leaving of the user, in case that a position coordinate of the RFID tag 1*a* of the article is deviated from the keeping range of the RFID tag 1*b* of the above-mentioned user, it is not judged that an article of this RFID tag 1*a* is a thing kept by the user.

By doing as above, when the specifying section 14 judges an article which was taken out by a user, who was judged to have left, from the safekeeping room 100, it notifies this specified result to the certification judgment section 15. The certification judgment section 15 judges whether the user is permitted to take out this article, in a combination of notified user and article, depending on the notification from the specifying section 14, with reference to the certification information 20. Then, when the certification judgment section 15 judged that taking-out of the above-mentioned article by the above-mentioned user is permitted, it instructs the output instruction section 16 to output such a manner that room-leaving of this user is OK.

The output instruction section 16 display-controls so as to display such a matter that leaving of the user with keeping the article is OK, on the display device 21, in response to this instruction from the certification judgment section 15, and instructs the reader/writer 2 through the external communication section 7 to write information of such a matter that taking-out has been already permitted, and the permitted user's ID information, in the RFID tag 1*a* of the article which was taken out.

Meanwhile, in response to this instruction, the reader/writer 2 writes the information of such a matter that taking-out has been already permitted, and the permitted user's ID information, in the RFID tag 1*a* of the article. Meanwhile, information to be written is not limited only to these, and for example, it is all right even if information, which shows an expiring date of taking-out permission, and so on are further written.

Then, a user, who was allowed to take out the article, leaves from the safekeeping room 100 with keeping the article.

On the one hand, in case that the certification judgment section 15 judged that taking-out of the above-mentioned article by a user is not permitted (in case of "NO" in S24), it instructs the output instruction section 16 so as to output taking-out disapproval of the article.

This output instruction section 16 controls so as to display such a matter that taking-out of the article by the user is not permitted, on the display device 21, in response to the instruction from the certification judgment section 15. In addition, the output instruction section 16 instructs, in this display device 21, so as to display a name of the article for which taking-out is not permitted, and so as for the use to return the article to an original storage position. Then, return of the article by the user is completed, and then, leaving of the user is permitted.

As above, in the monitor system 90 which relates to this embodiment, the specifying section 14 judges presence or absence of an article which is in the keeping range, at the time of leaving of a user, and thereby, can judge whether or not there is an article which is taken out by the user. Furthermore, the specifying section 14 can specify an article for which a position relation to the above-mentioned user is in the keeping range on a steady basis, with reference to the first history information 18 and the second history information 19, among articles which were judged to be in the keeping range at the time of leaving.

On this account, it is possible to prevent an article which happened to be in the vicinity of a user at the time of leaving (in the keeping range) from being erroneously recognized as the article which was taken out by the user. Therefore, the above-mentioned specifying section 14 can specify an article taken out by a user which left a room, with much higher precision.

In addition, as described above, in the above-mentioned monitor system 90, it was of such a configuration that it is possible to judge whether or not there is an article which exits in the keeping range of a user on a steady basis, by referring to a chronological change of position information of the RFID tag 1*b* and the RFID tag 1*a*, i.e., the first history information 18 and the second history information 19. Then, in the above-mentioned monitor system 90, it was of such a configuration that it is possible to specify a combination of a user and an article which enter/leave in/from the safekeeping room 100 concurrently, depending on whether an article exists in a keeping range of a user on a steady basis, or not.

On this account, even in case that a plurality of users keeping articles enter/leave in/from the safekeeping room 100 nearly simultaneously, it is possible to specify a combination of a user and an article which enter/leave.

Therefore, there is no need to restrict a gate width of the above-mentioned gate 80 in such a manner that, for example, a user enters/leaves one by one, and it is possible to design it freely, depending on a range of the transmission antenna 3 and the reception antenna 4, which the reader/writer 2 is equipped with, can communicate.

In addition, in the monitor system 90 which relates to this embodiment, the monitor device 10 is equipped with the certification judgment section 15. On this account, it is possible to judge whether or not taking-out of an article is permitted, in case that taking-out of the article is carried out by a user who leaves. Therefore, in the monitor system 90 which relates to this embodiment, it is possible to restrict taking-out of an article by a user, depending on a taking-out available article which is allocated with respect to each user.

Meanwhile, in the monitor system 90 which relates to this embodiment, as described above, it was of such a configuration that the specifying section 14 specifies an article which was taken out by a user, at the time of leaving of the user, depending on where there is an article in a keeping range, or not.

Furthermore, this specifying section 14 was of a configuration for specifying an article which was taken out by a user, depending on whether or not there is an article which was in a keeping range of a user, among articles specified with reference to the first history information 18 and the second history information.

Here, in the monitor system 90 which relates to this embodiment, it is all right even if it is configured in such a manner that an article of the RFID tag 1*a*, which was present in a keeping range of the RFID tag 1*b*, is specified as a thing which was kept by a user, at such a time point that return of a response signal from the RFID tag 1*b* was stopped, without recording the above-mentioned first history information 18 and the second history information 19.

In case of configuring in this manner, the above-mentioned monitor device 10 has no need to record respective position information of the RFID tag 1*a* and the RFID tag 1*b*, in a chronological order, as the first history information 18 . . . and the second history information 19 . . . , in the information storage section 17. On this account, it is possible to reduce an amount of data to be stored in the information storage section 17.

However, in the above-mentioned configuration in which the first history information 18 . . . and the second history information 19 . . . are not stored in the information storage section 17, it is judged that, on the occasion that leaving of a user was judged, all articles, which are present in a keeping range of the user, are judged as an article which was taken out by this user. On this account, for example as shown in the above-mentioned FIG. 13 or FIG. 15, in case that a plurality of articles exist in a keeping range of a user, it is not possible to specify an article which was taken out by the user, with high precision.

On this account, in order to specify an article which was taken out by a user, with high precision, it is desirable to configure to store the first history information 18 . . . as chronological data of position information of the RFID tag 1*b* . . . , and store the second history information 19 . . . as chronological data of position information of the RFID tag 1*b*, in the information storage section 17, as described in the above-described this embodiment.

In addition, in the above-mentioned embodiments 1 and 2, it was of such a configuration that the RFID tag 1 is equipped with a user and an article, and on the basis of respective position information, entering/leaving in/from the safekeeping room 100 is monitored. However, an object, which is equipped with the RFID tag 1 and is monitored, is not limited to this combination, and it is all right even if it is a combination of a human and a human, and it is a combination of a human and an animal, and it is a combination of a vehicle and a baggage.

Meanwhile, it is all right even if the communication processing section 5, the position measurement section 6, the area judgment section 8, and the external communication section 7, which the reader/writer 2, that relates to the above-described embodiments 1 and 2, is equipped with, are configured by hardware logic, and it is made as a configuration which is realized by such a matter that computing means such as CPU executes a program stored in storage means such as ROM (Read Only Memory) and RAM.

In addition, it is all right even if the external communication section 11, the information extraction section 12, the room entering/leaving monitor section 13, the specifying section 14, the certification judgment section 15, and the output instruction section 16, which the monitor device, that relates to the above-described embodiments 1 and 2, is equipped with, are also configured by hardware logic, and it is made as a configuration which is realized by such a matter that computing means such as CPU executes a program stored in storage means such as ROM (Read Only Memory) and RAM.

In case of configuration the above-mentioned each section by computing means such as CPU and storage means, a computer having these means reads out a recording medium on which the above-mentioned program was recorded, and executes the program, and thereby, it is possible to realize various functions and various processing of the communication processing section 5, the position measurement section 6, the area judgment section 8, and the external communication section 7. In addition, by recording the above-mentioned program on a removable recording medium, it is possible to realize the above-mentioned various functions and various processing on an arbitrary computer.

As this recording medium, in order to carry out processing by a computer, it is all right even if a memory which is not shown in the figure, for example, a thing like ROM, is a program medium, and also, although it is not shown in the figure, it is such a problem medium that a program reading device is disposed as an external storage device and a recording medium is inserted into it and thereby, recording is possible.

In addition, in any case, it is desirable that a program, which has been stored, is of such a configuration that a microprocessor accesses to it and it is executed. Furthermore, it is desirable that a program to be read out is of such a method that it is downloaded in a program storage area of a microcomputer and that program is executed. Meanwhile, it is assumed that this program for use in download has been stored in a main body device in advance.

In addition, in case of a system configuration which can be connected to a communication network including Internet, it is desirable that it is a recording medium which supports a program in a floating manner, so as to download the program from the communication network.

Furthermore, in case of downloading a program from a communication network in this manner, it is desirable that the program for use in download has been stored in a main body device in advance, or is a thing which is installed from another recording medium.

The present invention is not limited to the above-described each embodiment, and various modifications are possible in a scope shown in claims. That is, embodiments, which are obtained by combining arbitrarily modified technical means in the scope shown in the claims, are also included in a technical scope of the present invention.

An information processing apparatus and a monitor system which is equipped with this, which relate to the present invention, are applicable to, for example, the above-mentioned system for carrying out taking-out restriction of an article by a user, monitoring thefts of articles in a safekeeping room etc., and a system for policing illegal taking-out. Furthermore, it is also applicable to a system for recording a relation between articles in a store and movement of users to carry out management of a single item, and realizing selection of goods and layout, depending on a customer type.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

I claim:

1. An information processing apparatus which carries out processing for receiving information from a communication device that calculates position information of an identification device which is disposed for each of plural monitor targets in a communication area by communication with the identification device, the information processing apparatus comprising:

a reception section which receives the calculated position information from the communication device, and a specifying section which specifies a combination of monitor targets which enter in and leave from a predetermined region concurrently, on the basis of position information received by the reception section.

2. The information processing apparatus as set forth in claim 1, further comprising:

an entering/leaving judgment section which judges presence or absence of entering-in/leaving-from the predetermined region of at least one monitor target, among the plural monitor targets, on the basis of the position information, wherein in case that the entering/leaving judgment section judges that there is a monitor target which enters in and leaves from the predetermined region, the specifying section specifies another monitor target which enters in and leaves from the predetermined region, together with the monitor target, on the basis of the position information.

3. The information processing apparatus as set forth in claim 2, wherein, in case that it is judged by the entering/leaving judgment section that plural monitor targets enter in and leave from the predetermined region nearly simultaneously, the specifying section specifies a combination of monitor targets which enter in and leave from the predetermined region concurrently, about each of the monitor targets, on the basis of position information of each of the monitor targets.

4. The information processing apparatus as set forth in claim 2, wherein, in case that a monitor target for which it is judged by the entering/leaving judgment section that there is entering/leaving in/from the predetermined region is set as a first monitor target, the specifying section specifies a second monitor target which exists in a predetermined distance range from the first monitor target, to be a monitor target which enters in and leave from the predetermined region together with the first monitor target.

5. The information processing apparatus as set forth in claim 2, further comprising:

a history recording device which records history information that is a history of position information received from the communication device by the reception section, wherein the entering/leaving judgment section judges entering/leaving of the monitor target in/from the predetermined region, on the basis of the history information.

6. The information processing apparatus as set forth in claim 1, wherein the position information is information which shows a distance from the identification device up to the communication device.

7. The information processing apparatus as set forth in claim 1, wherein the position information is a two-dimensional coordinate or a three-dimensional coordinate of the identification device in the predetermined region.

8. The information processing apparatus as set forth in claim 1, further comprising:

a combination information storage device which stores combination information that shows advisability of a combination of monitor targets that enter in and leave from the predetermined region; and an advisability judgment section which judges, in the combination of monitor targets which are specified by the specifying section, that both of them can be entered and left, concurrently, on the basis of the combination information.

9. The information processing apparatus as set forth in claim 8, further comprising:

an output section which outputs information that shows a judgment result by the advisability judgment section.

10. The information processing apparatus as set forth in claim 1, wherein the identification device is a RFID tag.

11. A monitor system comprising:

the information processing apparatus as set forth in claim 1, and a communication device having a position information calculation section which calculates position information of each of identification devices, on the basis of a signal which is transmitted from the identification device which is disposed for each of plural monitor targets, and a transmission section which transmits the calculated position information to the information processing apparatus.

12. A control method of an information processing apparatus of carrying out processing for receiving information from a communication device which calculates position information of an identification device, which is disposed for each of plural monitor targets, in a communication area, by communication with the identification device, the method comprising steps of:

receiving the calculated position information from the communication device, and specifying a combination of monitor targets which enter in and leave from a predetermined region, on the basis of the received position information.

13. A program executable on a computer for operating an information processing apparatus of carrying out processing for receiving information from a communication device which calculates position information of an identification device, which is disposed for each of plural monitor targets, in a communication area, by communication with the identification device, said program comprising instructions having:

a first function of receiving the calculated position information from the communication device, and a second function of specifying a combination of monitor targets which enter in and leave from a predetermined region, on the basis of the received position information.

14. A computer-readable medium including a program executable on a computer for operating an information processing apparatus of carrying out processing for receiving information from a communication device which calculates position information of an identification device, which is disposed for each of plural monitor targets, in a communication area, by communication with the identification device, said program comprising instructions having:

a first function of receiving the calculated position information from the communication device, and a second function of specifying a combination of monitor targets which enter in and leave from a predetermined region, on the basis of the received position information.

* * * * *